United States Patent [19]

Engel et al.

[11] Patent Number: 5,002,337

[45] Date of Patent: Mar. 26, 1991

[54] STACKABLE AND LINKABLE CHAIRS

[75] Inventors: Harmut Engel, Freiberg am Neckar; Manfred Elzenbeck, Steinheim, both of Fed. Rep. of Germany

[73] Assignee: August Froscher GmbH & Co. K.G., Steinheim, Fed. Rep. of Germany

[21] Appl. No.: 409,231

[22] Filed: Sep. 19, 1989

Related U.S. Application Data

[63] Continuation of Ser. No. 268,679, Nov. 7, 1988, abandoned, which is a continuation of Ser. No. 45,213, Apr. 28, 1987, abandoned, which is a continuation of Ser. No. 919,628, Oct. 15, 1986, abandoned, which is a continuation of Ser. No. 509,970, Jun. 30, 1983, abandoned.

[30] Foreign Application Priority Data

Jul. 2, 1982 [DE] Fed. Rep. of Germany ..... 3224812

[51] Int. Cl.[5] ..... A47C 3/04

[52] U.S. Cl. ..... 297/239; 297/449; 108/53.3

[58] Field of Search ..... 208/53.1, 53.3, 91; 297/239, 248, 445, 449, 418; 248/188.8, 188.9

[56] References Cited

U.S. PATENT DOCUMENTS

| | | | |
|---|---|---|---|
| 1,408,114 | 2/1922 | Mathieu | 297/239 |
| 3,156,498 | 11/1964 | Blodee | 297/239 X |
| 3,276,813 | 10/1966 | Durfee et al. | 297/445 |
| 3,497,262 | 2/1970 | Piretti et al. | 297/239 |
| 3,712,668 | 1/1973 | Fink | 297/239 |
| 4,411,471 | 10/1983 | Ponzellini | 297/239 |

FOREIGN PATENT DOCUMENTS

| | | | |
|---|---|---|---|
| 2149542 | 6/1973 | Fed. Rep. of Germany | 297/445 |
| 130749 | 3/1977 | German Democratic Rep. | 297/239 |
| 90926 | 10/1921 | Switzerland . | |
| 438816 | 5/1964 | Switzerland . | |
| 953249 | 2/1963 | United Kingdom . | |

*Primary Examiner*—Joseph Falk

*Attorney, Agent, or Firm*—Robert E. Burns; Emmanuel J. Lobato

[57] ABSTRACT

A stackable chair has a leg frame on which a seat and back are mounted. The leg frame comprises two lengths of flat tubing of dumb-bell shaped cross section bent to provide contiguous parallel portions which extend centrally transversely of the seat, portions extending from the ends of the parallel portions toward corner regions of the seat and portions bent downwardly to form the legs which are substantially in a vertical fore-and-aft plane but incline forwardly and rearwardly. When the chairs are stacked the legs of dumb-bell cross section nest with one another. The seat has a width substantially equal to the overall width of the leg frame and has cut-out corner regions to accommodate legs of superposed chairs when stacked. Plastic gliders at the bottom of the legs have support portions extending up along the legs for supporting superposed stacked chairs. The seat and back are mounted on the leg frame by two like supporting and connecting members at opposite sides of the chair, which also have provision for attaching an arm by a single screw or bolt or attaching a linking element for connecting chairs side by side in a row. The linking element is reversible so that it can be mounted with flat connecting lugs on the element directed either up or down.

27 Claims, 22 Drawing Sheets

Fig. 19
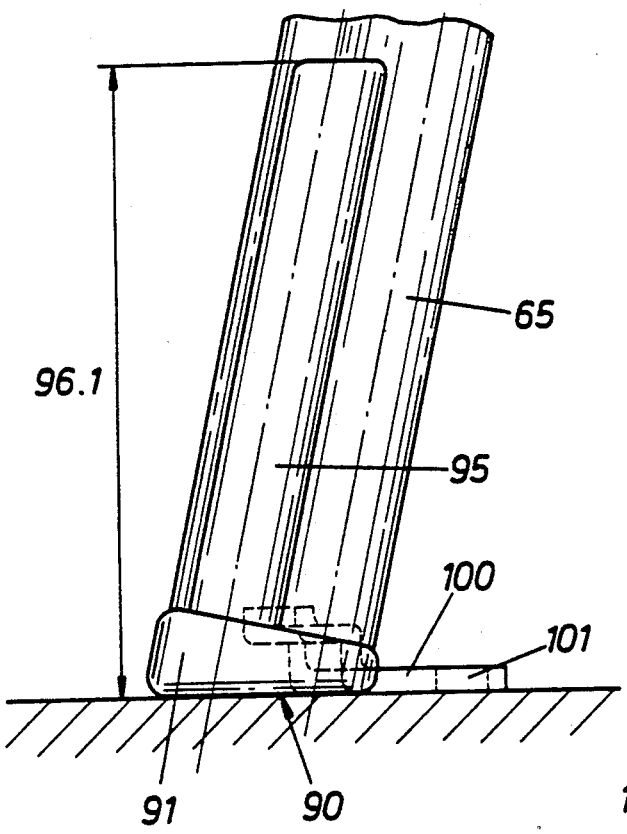
Fig. 18
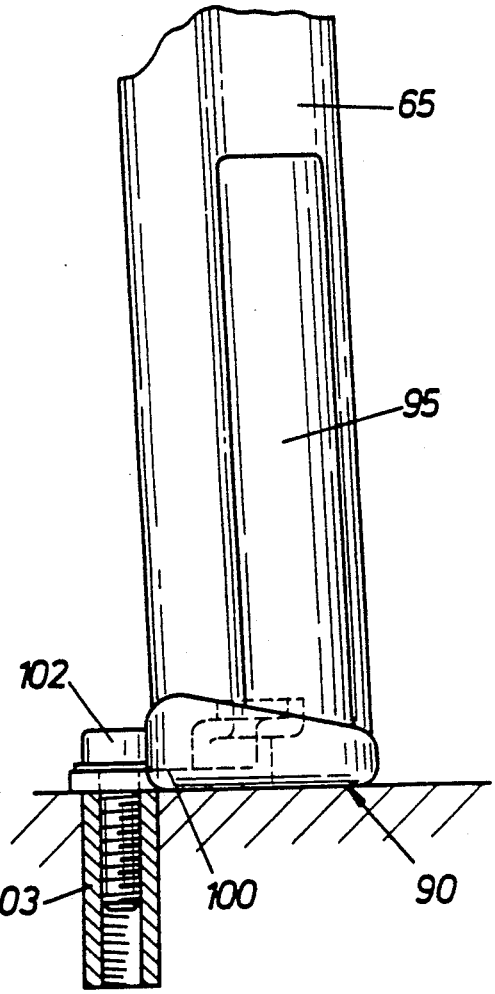
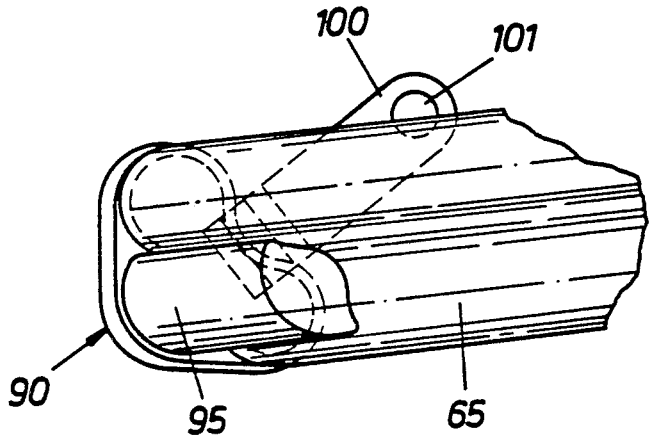
Fig. 20

STACKABLE AND LINKABLE CHAIRS

This application is a continuation of application Ser. No. 07/268,679 filed Nov. 7, 1988 (now abandoned) which is a continuation of application Ser. No. 07/045,213 filed Apr. 28, 1987 (now abandoned) which is a continuation of application Ser. No. 06/919,628 filed Oct. 15, 1986 (now abandoned) which is a continuation of application Ser. No. 06/509,970 filed June 30, 1983 (now abandoned).

FIELD OF INVENTION

The present invention relates to chairs and in particular to chairs that are stackable one on another for storage and are linkable to connect a plurality of chairs together in a row.

BACKGROUND OF INVENTION

Chairs are among the oldest useful articles of man and are consequently known in an almost unimaginable number of forms. These forms are oriented not only to the basic purpose of sitting or comfortable sitting but also to the possibility of production costs and among others to the possibility of providing the chair with other objects such as arm rests or coupling devices for connecting the chairs in a row or to make different chairs out of largely the same parts. In addition to leg frames made of wood many frames made of metal are also known. There are two main groups. The one comprises legs made of tubing and the other of legs of solid material produced by extrusion. molding or in other manner. The principal materials used are steel, aluminum and glass fiber reinforced plastic. The steel tube frame has as a rule a round or square cross section. Chairs which must frequently be removed from an assembly hall or the like and stored are made stackable. There are basically two possibilities, namely stacking one over another and placing one in front of another. For chairs to be stacked on one another the legs have, for the most part, been relatively inclined and converge in or near the region of the point of gravity in a somewhat V-form arrangement. These legs lie outside the seating surface because the relatively slightly inclined legs must slide over a greater length in stacking. Such chairs are disclosed for example in DE-OS 20 35 974,25 59 196, and 26 24 492 and moreover, are widely known in other forms in practice. Their appearance with the V-form legs converging at the center of gravity any lying outside the seating surface is regarded by many room outfitters as too plain so that they give the room the character of a plainly equipped hall. There is hence the need to make available a stackable chair which has an appearance corresponding to or approaching that of a normal chair Such stackable chairs are for example known from DE-GM 77 08 560 and DE-AS 28 00 564. These have round, approximately vertical tubular legs with the rear legs offset outwardly from the front legs so that the front legs of stacked chairs can fit in front of one another and the rear legs fit next to the seating surface. However, these chairs do not permit attaining the appearance of a normal chair with a wider seating surface. With the front stackable chairs according to DE-AS 23 53 341, an arrangement of four vertical legs is not provided and is not possible Moreover, a U-form bow is provided in spaced planes. Also, this chair cannot be given the appearance of a chair for a living room or a pleasant assembly room. The leg construction of this chair requires special, quite expensive production and assembly technics.

Moreover, there is known in practice a stackable chair of glass fiber reinforced plastic (so called Bofinger chair) in which four legs are formed integral with a one piece seat and back shell so that the forward legs are set in the corners of the seating surface while the back legs are formed somewhat outside the side edge lines of the seat so that they are more widely spaced than the forward legs. All of the legs are angular in cross section with their apices pointing toward the middle so that, on stacking, the legs fit inside one another. Such chairs can indeed be used as stacking chairs but cannot be linked in a row because the legs are inclined outwardly so that there would be large spaces between the seating areas.

SUMMARY OF THE INVENTION

Proceeding from this state of the art the invention is directed to the problem of providing a chair which is stackable and linkable and with the widest possible seating surface can be placed in a row close to the next chair and can moreover be stacked vertically on one another while being similar in appearance to non-stackable and non-linkable chairs.

In accordance with the invention there is provided a chair comprising at least a leg frame, seat and back with the legs inclined for stacking and with the seat and back secured to the leg frame. The seat width corresponds approximately to the width of the leg frame while corner portions of the seat corresponding to the position and size of the legs are cut away and the legs located in the cut away portions of the seat have a cross sectional shape of dumb bell or "peanut" form so that when the chairs are stacked, the thicker portions of the upper legs fit in the recesses of the lower legs.

Whereas with prior stackable chairs, the legs or at least the rear legs, are wider than the middle portion of the seat, the seat in accordance with the invention extends to the full width of the leg frame. To accommodate the legs when the chairs are stacked, the corner portions of the seat in particular the rear portions, are cut away so that these areas are free.

These corner portions are not necessary for supporting a seated person when they are located sufficiently forwardly and rearwardly. Thereby, it is possible to incline the legs only slightly so that they are almost vertical. So that they can nevertheless be stacked and to provide a stable but slender leg, there is selected a form which, with great stability and thus a favorable moment of inertia, nevertheless has recessed areas which lie near the central axis so that when the chairs are stacked, the outer thickened portion is received in the central recessed portion. Such a leg frame can easily be produced of bent tubing and can be joined with the seat and back with simple and economical means. As the frame is advantageously formed of tubing, the relatively high expense of large volume molded parts is avoided and nevertheless there is provided an interesting departure from the usual round or square tubing.

Through the interfitting profile, it is possible to obtain a very limited stacking height despite the wide and almost vertical legs so that many chairs can be stacked one on another in a small space. Because of the vertical stacking, no complicated inclined stacking carts or the like are required and optimal use can be made of the stacking room. With the exception of the V-form legs adjacent the seating surface, almost all other known stacking chairs form a stack which is inclined forwardly or rearwardly so that a stack of chairs must be brought into transport or storage position by suitable accessory means so that it will not fall over.

The leg frame can be made in many ways with the use of suitable metal profiles when the legs as described above overhang the cut out corner areas of the seat. A leg frame which is especially easy to produce, stable and can be easily joined with the seat and back comprises two tubular parts of dumb bell shape cross section which are bent to form two downwardly extending legs and a bent connecting portion under the seat whereby the two portions are joined with one another under the seat and provided with means for joining the seat and back. Other means can be used for joining the leg parts with one another. However, an especially simple and stable construction is provided when the two frame parts have two parallel portions which are welded to one another, then extend diagonally to the corners of the seat where they are bent downwardly to form the legs. With this construction, a straight piece of tubing needs to bent only four times and only two like parts are welded to one another to provide an attractive, stable and light stackable leg frame.

For the dumb bell shape flat profile, in particular flat tube profile, various forms can be used. In particular, it can be formed in the manner of a double barreled gun and for example out of circular arcs joined together, for example out of two approximately ¾ circles and inwardly bent quarter or third circles therebetween. This rounded profile does not tend to bow out and can support high loads even with limited wall thickness. The flat tube profile can also be formed of two squares with their corners: turned toward one another whereby the adjacent corners merge into one another. The flat tube profile can also be formed of two hexagons or of two octagons correspondingly joined. The profile tube can be formed of flat sheet metal which is formed by a cylinder and roll process and welded with a longitudinal seam in the region of the central recess. Also the tube can be seamless with corresponding profile.

For stacking, suitable stacking supports are provided in the region of the seat, on the seat and/or the leg frame. The special leg form with dumb-bell shaped profile which, as with all metal chairs, is provided with a glider on each leg, permits these to be used as stack supporting elements in that the legs with dumb bell shaped tubular profile are provided at their lower ends with correspondingly formed gliders which are formed with supporting surfaces. Plastic elements, easily formed by injection molding, provide closures for the lower ends of the tubular legs and supporting surfaces for stacking. The glider inserts or stacking support elements can be provided with detent hooks which grip in openings in the leg profile. The gliders are thereby securely fastened to the legs and can support the weight of the stack. In the glider there can be inserted a clip which can be screwed fast to the floor. For this purpose the glider can be provided with a recess so that the chair can by simple means be immovably secured in a room or in a garden enclosure.

The connection between the leg frame and the seat can be effected in a variety of ways, for example through interengaging locking elements or the like. In particular the connecting elements can be screws, rivets or bolts under the seat, slightly inside the corner portions Thus the fastening of the seat over the large support area is possible.

The back and the seat can for example be formed as a one piece shell or as a one piece shell for the mounting of upholstery. Thus it is possible merely to secure this one piece unit to the leg frame.

Another suitable construction for a light and stable chair which can be varied according to the wishes and needs of the customer is that a special seat and back holding connecting and supporting part is provided on which the seat and separate back are secured. This can be symmetrical with respect to both sides of the chair and comprises fastening and seat supporting shanks which run approximately horizontally under the side edges of the seat, inwardly inclined portions following the cut-out corner portions of the seat and upwardly and rearwardly inclined portions which merge into back supporting portions following lower and side edges of the back. Such a connecting and supporting part is relatively small and can consequently be economically produced by a suitable forming process and is provided with fastening openings, tapped holes or the like. It is then secured to the leg frame and on the thus partially finished chair a covered seat and a correspondingly covered back can be secured according to the wishes of the customer. Alternatively, the seat and back can be formed of perforated sheet metal or other material. The connecting and supporting part is suitably formed as die cast aluminum. It can thus be simply and economically produced in spite of the relative complicated form and is light weight in spite of its great stability. It can also be used for connecting other elements and can be formed with sufficient local strength. In combination with incombustible or fire resistant seats and backs, there can be realized chairs having a high fire resistance which is especially desirable for use in halls used for large assemblies.

With many known chairs, there are a variety of ways for fastening arm rests. These are either formed integrally with the legs or as separate members. For the connection of the arm rests, it is usual to provide in the region of the side edges of the seat a cross reinforcement from which supporting arms project upwardly for the arm rest. As a rule, the cross connection comprises two holes through which screws extend for fastening on the leg frame or the sheet shell. If necessary, further fastenings are provided. The fastening with two screws leads to a corresponding mounting expense. Through the construction in accordance with the invention this is reduced. By virtue of an inset connection between the arm rest and the leg frame or between the leg frame and the seat and back supporting member the arm can be secured with a single screw.

For this purpose the connecting and supporting part or the leg frame or seat shell in the region of the middle of the side edge of the seat is provided with an overlapping fastening profile which adjacent a supporting groove for the seat has in cross section a roof form supporting part of which the outer edge merges into a fixed surface which is inclined at least about 100° to 105° to the outer roof slope or less than 10° to 15° to the inner roof slope and merges into a vertical shank having a screw bore. This profile can provide a good stress and and wear resistant support for the seat when no arm rest is provided. On the vertical screw-bored shank a row connection can be screwed also without an arm rest.

However, in a further form of the invention, there can be provided an interchangeably secured arm rest which in a lower part has an overlapping profile corresponding to the fastening profile which has a sufficient supporting width or supporting surfaces spaced from one another and a central bore for a single tightening screw for securing the arm rest to the fastening profile.

On the connecting and supporting part with a vertical shank having a screw hole, there can be applied, if need be, a row connecting element which for example is formed with a U-profile of which one shank is formed with two flat lugs which on one side of the chair are directed upwardly and on the other side downwardly and which fit in corresponding recesses in the web profile. In order to have a row connecting element of the same form for connecting plain chairs and chairs with arm rests and so to provide for interchangeably connecting plain chairs and chairs with arm rests with one another a further form of the invention comprises a profile part of metal or plastic in the mid-region of the side of the chair which has two spaced flat lugs between which there is provided a round V-recess and whereby preferably the bottom region is provided with a through opening for the flat lug points of the neighboring element. Such an element with a V-recess can be used for each row connection. For connecting a chair having an arm rest, there is provided a flanged element through which the fastening screw for the arm rest extends and which projects beyond the outer surface of the arm rest. The rounded V-recess of the neighboring chair fits over the flange of the flange element from above or from underneath so as to link the chairs together. Thus for a chair having an arm it is necessary only to use a longer screw with a small cylindrical part and a larger disc or a corresponding flange part for connecting the chairs with no greater spacing than plain chairs. The middle of the arm rest can lie over the outer edges of the feet so that there is a single arm rest between two chairs.

The arm rest preferably has supporting arms which extend upwardly from the fastening part and provide a support for a pivoted arm rest.

Pivoted arm rests are known from DE-GM 81 03 946. In a stacking stool, this serves the purpose of providing a smaller dimension folded up. The arm rest is hinged on a one arm support part by means of a longitudinal pivot shaft and can be locked and unlocked by axial movement. The support is relatively expensive and the arm rest must be made very stable because it is supported on only one side. Through the invention, there is provided a two sided support with a simple pivot bearing and a simple locking device. In accordance with the invention there is provided a plastic arm rest of U-shaped cross section which is pivoted to swing outwardly about a longitudinal axis. The arm rest is sufficiently elastic for mounting but sufficiently stiff for use. The arm rest support is provided with an abutment surface for positioning the arm rest in a horizontal position and an abutment surface for positioning the arm rest in a vertical position At the ends of the arm rest support, there are projections which are received in elastic end portions of the arm rest to secure the arm rest in horizontal position.

Apart from the two necessary parts, namely the supporting arm and the pivoted arm rest, such a pivoting and locking arrangement requires only one additional part namely the pivot bearing element and requires no hinge pin or fixing element but can by suitable dimensioning be easily assembled from performed parts and is then usable and can easily be swung to both positions.

BRIEF DESCRIPTION OF DRAWINGS

The nature objects and advantages of the invention will be more fully understood from the following description of preferred embodiments shown by way of example in the drawings in which:

FIG. 18 is a partial front view of a chair leg provided with means for fastening it to the floor.

FIG. 19 is a partial side view of a chair leg with a plate for fastening it to the floor.

FIG. 20 is a partial plan view of a chair leg with a plate for fastening it to the floor.

DESCRIPTION OF PREFERRED EMBODIMENTS

Figure 1:
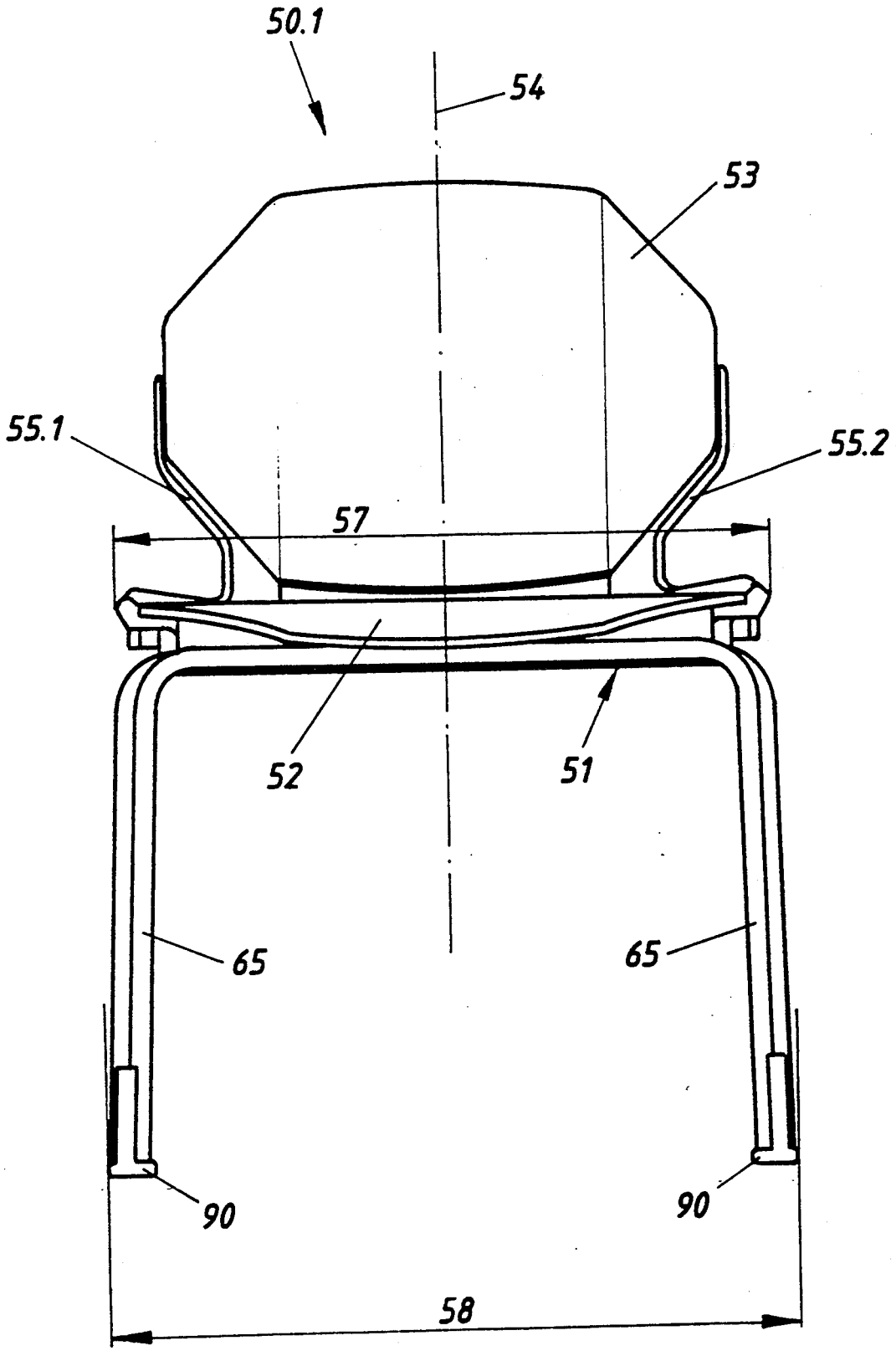
FIG. 1 is a front elevation of a chair in accordance with the invention.

In the drawings, different embodiments of the chair 50 are designated by the decimals .1 to .5. However, the basic construction of all of the chairs is the same.

The chair 50 comprises a leg frame 51, a seat 52, a back 53 and two connecting and supporting parts 55.1 and 55.2 which are symmetrical with respect to the longitudinal axis 54 of the chair.

Figure 6:
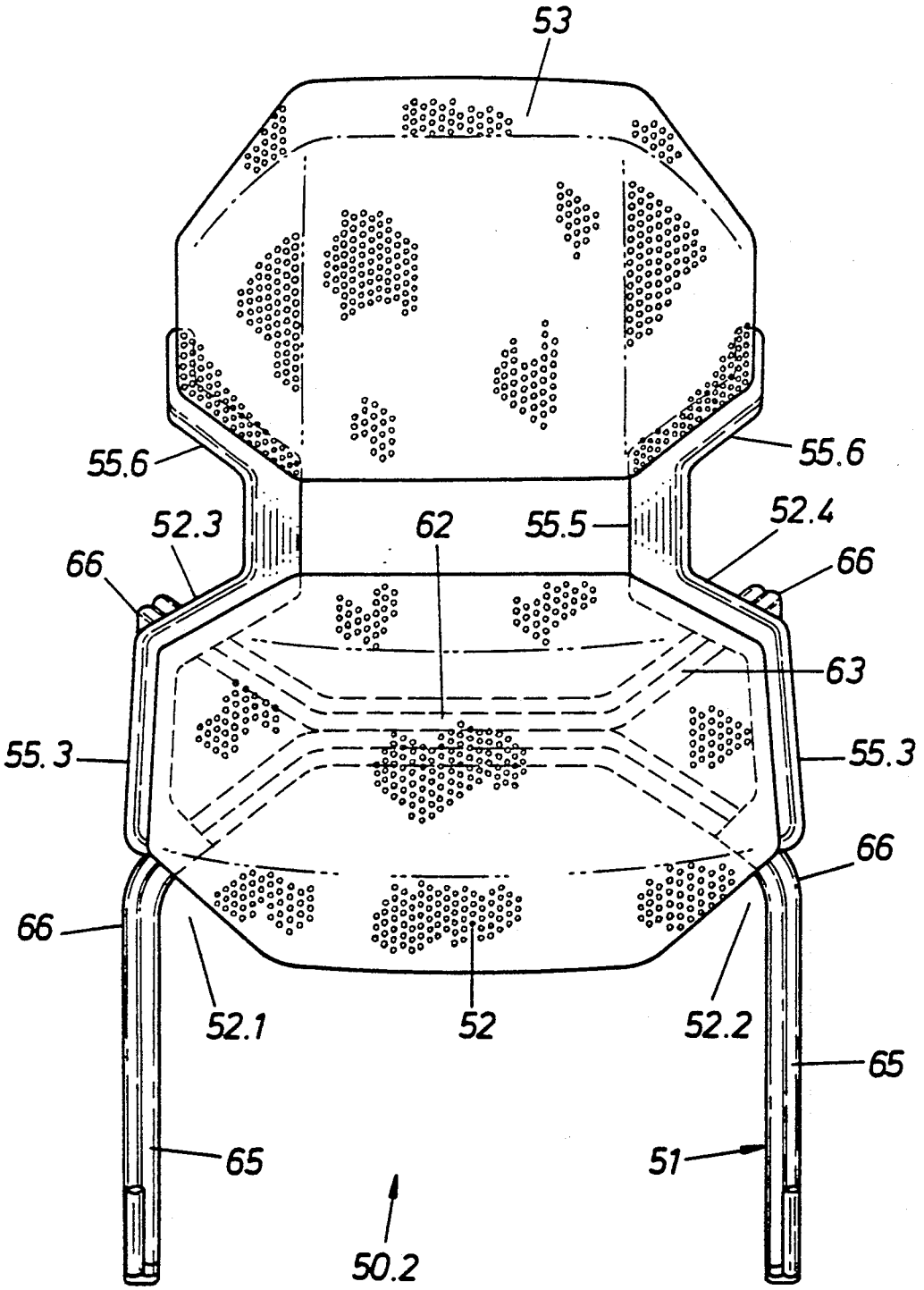
FIG. 6 is a perspective view of the chair of FIGS. 4 and 5 looking diagonally downwardly, the seat and back being formed of somewhat transparent perforated sheet metal.
Figure 7:
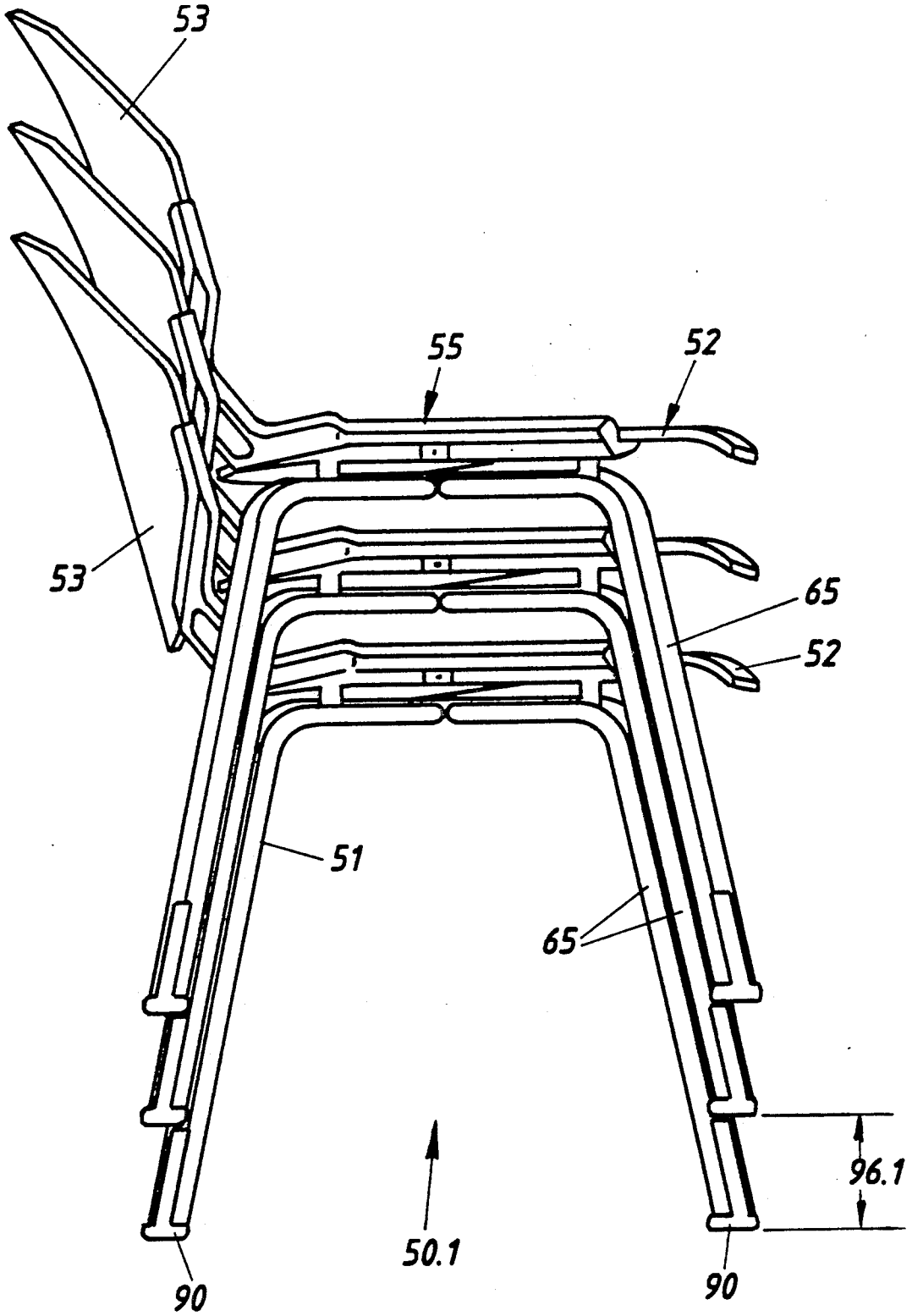
FIG. 7 is a side elevation showing a plurality of chairs stacked one on another.

The seat 52 has a width 57 and the leg frame 53 has an overall width 58. As seen in FIG. 1, these are substantially the same so that the legs 65 of the leg frame are arranged under the seat 52 and do not project laterally as in the usual stackable chair. As seen in the plan view of FIG. 3, the seat 52 is approximately octagonal with sides of unequal length so that corner areas 52.1–52.4 are in effect cut off or missing while the front edge 52.5 and the rear edge 52.6 are slightly rounded. The side edges 52.7 and 52.8 are straight and are parallel to one another. The seat 52 can be formed as a profiled wood or plastic shell, an upholstered wood or plastic shell, as a profiled sheet metal shell or as illustrated in FIG. 6, a shell of perforated sheet metal.

Figure 5:
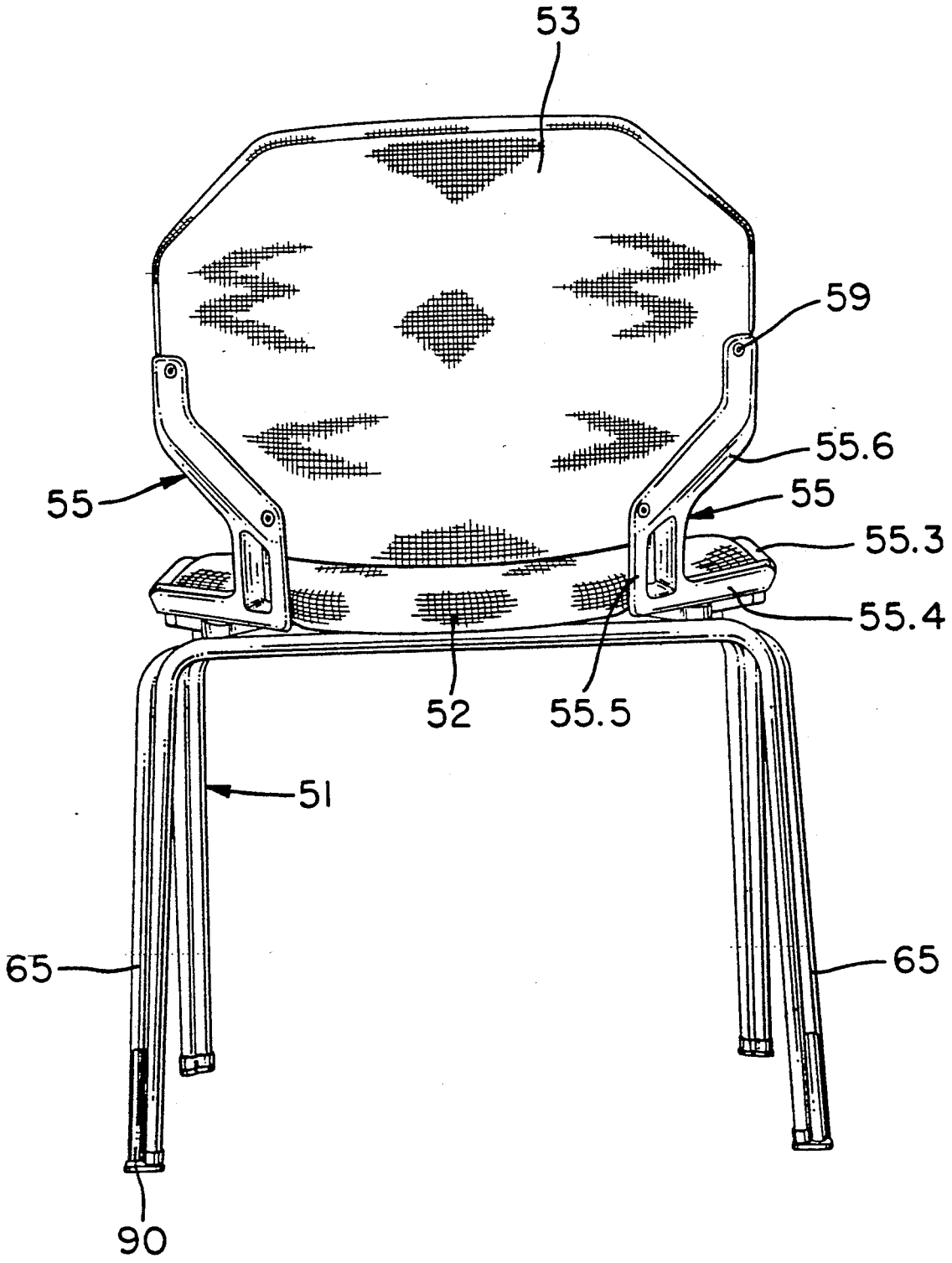
FIG. 5 is a rear perspective view of the chair of FIG. 4 as seen from somewhat above the middle.
Figure 35:
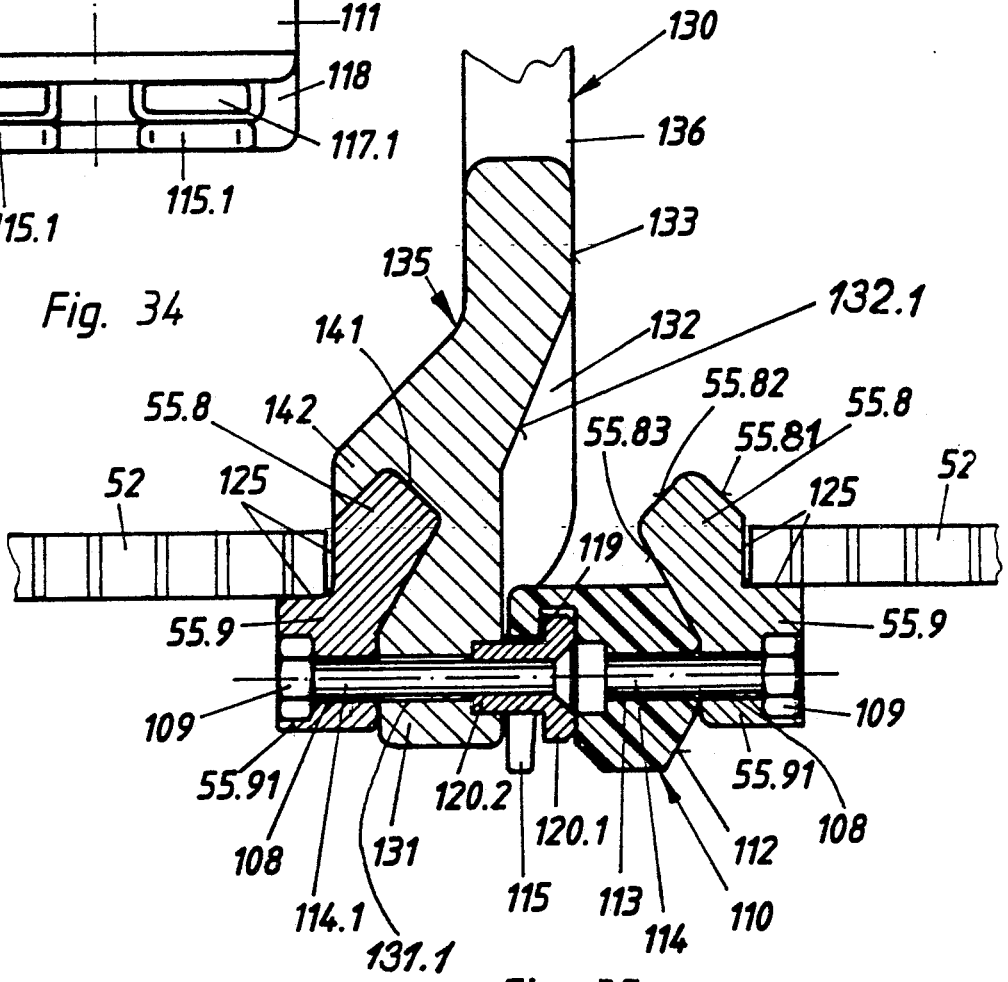
FIG. 35 is a partial vertical section through adjacent side portions of two chairs showing the screws for fastening the arm rest and for connecting the linking element.

The connecting and supporting parts 55 are best seen in FIG. 5. One is provided at each side of the seat. Each extends along the profile of the side edge of the seat 52.7, 52.8 and along the edge 52.9 defining a rear corner cut-out portion of the seat. As seen in FIG. 35, the side portion has a recess 125 to receive the side edge of the seat 52, a horizontal supporting portion 55.9 under the seat and a vertical portion 55.8 extending up alongside the seat. At the rear edge of the seat, the connecting and supporting part 55 extends upwardly in a portion 55.5 which merges into a portion 55.6 following the outer contour of the back 53. As illustrated in FIG. 5, the back like the seat is in the form of an octagon with unequal sides with parallel side edges with corners cut away at an angle of about 45° and with slightly rounded upper and lower edges. However, the back is narrower than the seat. The back supporting portions 55.6 of the connecting and supporting parts 55 extend essentially along the lower inclined corner edges and about half way up the parallel side edges. Suitable connecting means for example screws 59 serve to secure the back to the connecting and supporting members 55.

Figure 3:
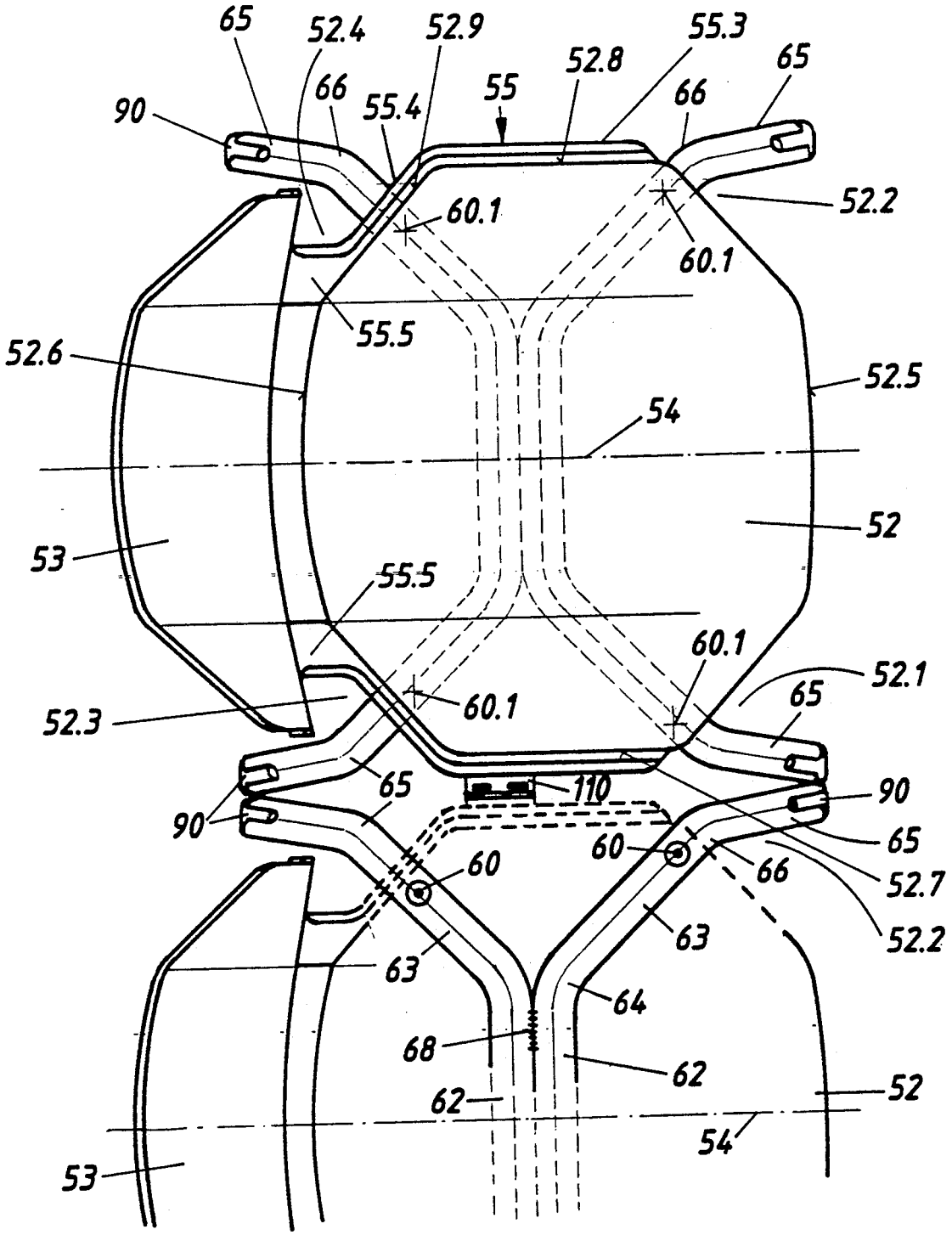
FIG. 3 is a partial plan view of two chairs illustrating the link between them, a portion of the seat of one chair being broken away to show the leg frame.
Figure 4:
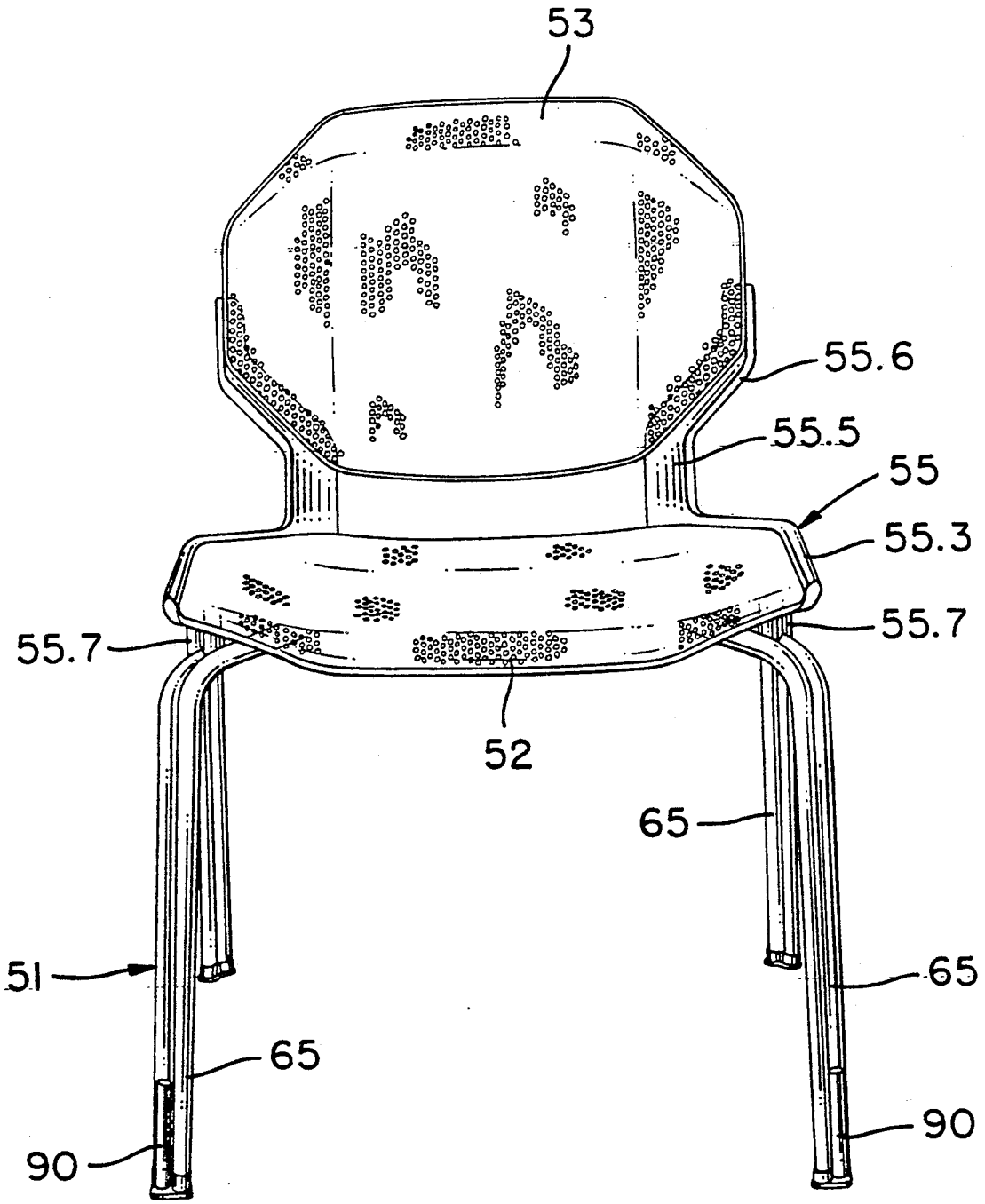
FIG. 4 is a front perspective view of a similar chair as seen from somewhat above the middle.

The connecting and supporting parts 55 have under their horizontal portions 55.3 and 55.4 cylindrical projections 55.7 located slightly inwardly of the inclined boundary edges of the cut-out portions 52.1–52.4 and resting on the leg frame 51. The projections 55.7 are bored to receive screws 60 for fastening the connecting and supporting parts 55 to the leg frame. Alternatively, rivets, bolts or other connecting means can be used. As seen in FIG. 3, there are four fastening points which are indicated by the crosses 60.1. The cylindrical projections 55.7 are located at these points. It will be seen that the projections 55.7 are located on forward and rearward end portions of the horizontal portions 55.3 and 55.4 of the connecting and supporting parts 55.

Figure 2:
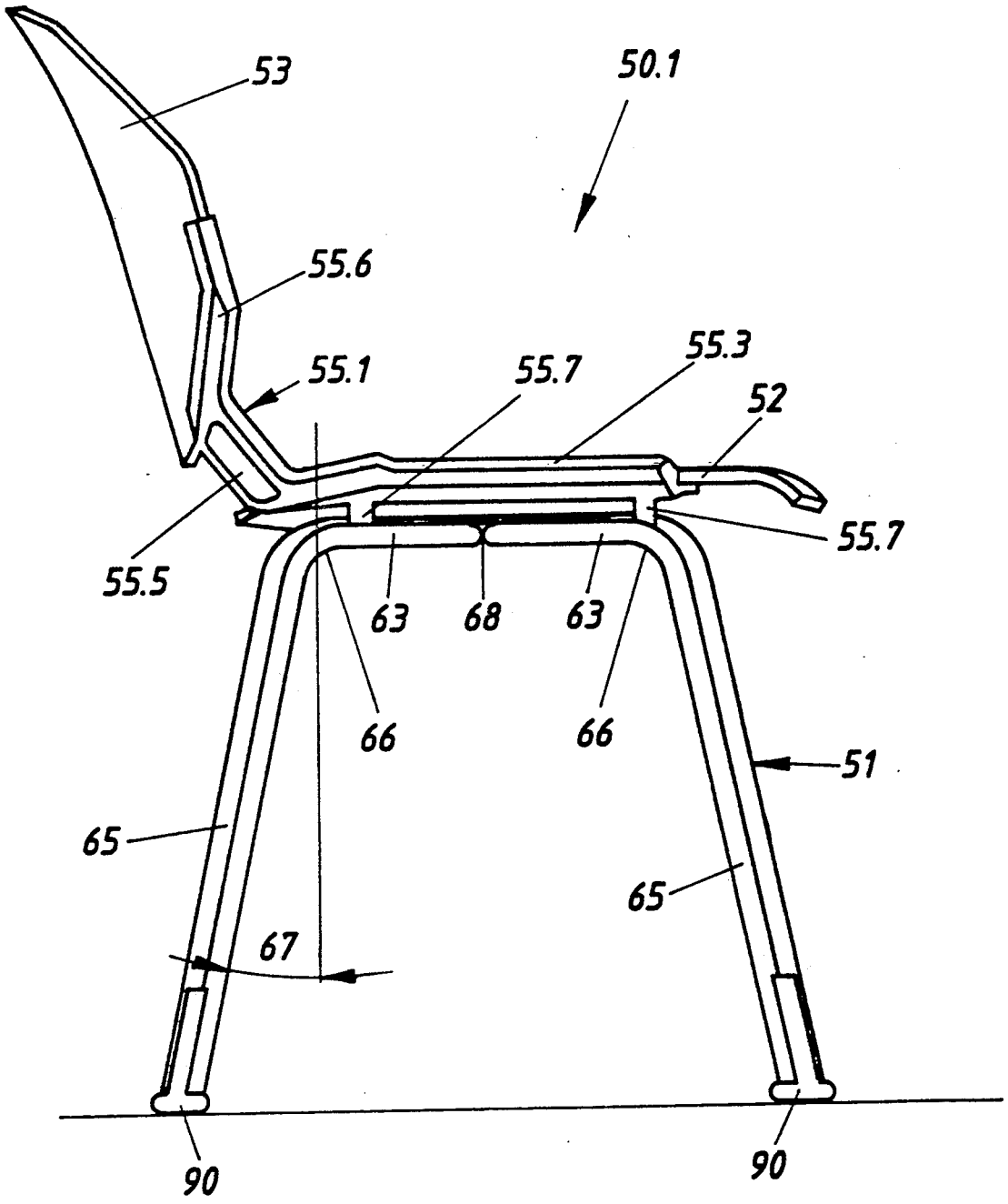
FIG. 2 is a side elevation of the chair shown in FIG. 1.

As described above, the seat 52 and back 53 rest on the leg frame 51. This comprises two flat tubes 61 which as seen in FIG. 3 have two straight, horizontal portions perpendicular to the chair axis 54. At the ends of these straight portions, the tubing is bent at 64 to provide angular portions 63 which extend to and beyond the cut-out corner portions of the seat. There the tubing is bent at 66 to provide downwardly extending legs 65. As seen in FIG. 1 the legs are practically vertical as seen in front elevation while in side elevation as seen in FIG. 2, the front legs are inclined forwardly and the rear legs are inclined rearwardly at an angle 67 of about 12° to the vertical. The two flat tube parts 61 are formed alike with like angles and in the region of the central portions 62 are welded to one another as indicated at 68 (FIGS. 2 and 3). The flat tube comprises sheet metal tubing of a particular profile. This profile is formed and arranged in a particular manner to achieve high stability with good stacking properties and limited stacking height. The major axis 71 of the tubing lies at about 45° to the longitudinal axis 54 of the chair.

Figure 8:
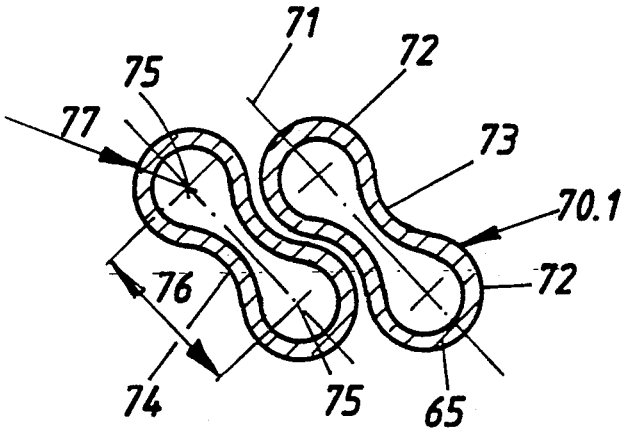
FIGS. 8 to 11 are schematic cross sectional views showing four different leg profiles and illustrating how the legs of two stacked chairs interfit the section being taken along the line 8-11 in FIG. 13.
Figure 9:
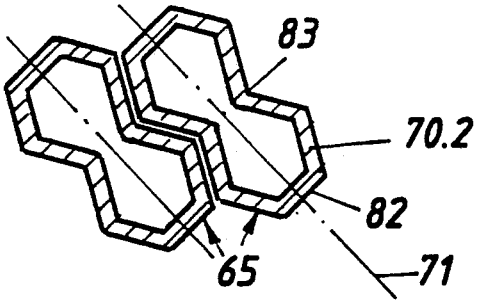
Figure 10:
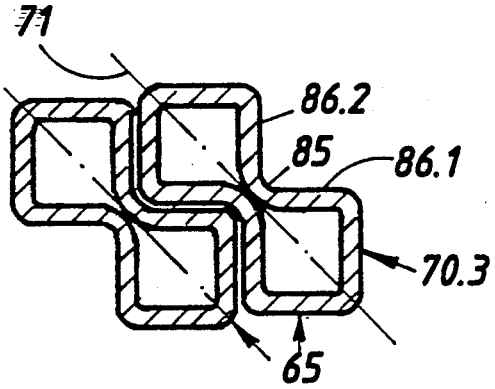
Figure 11:
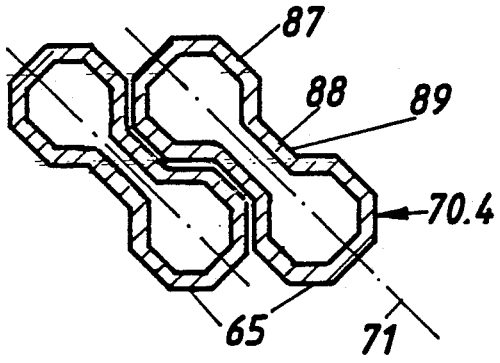
Figure 16:
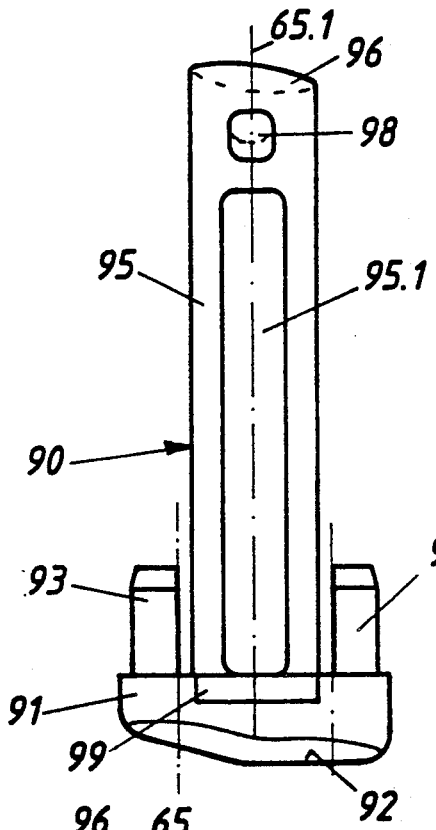
FIG. 16 is a front view of the glider of FIG. 15.
Figure 15:
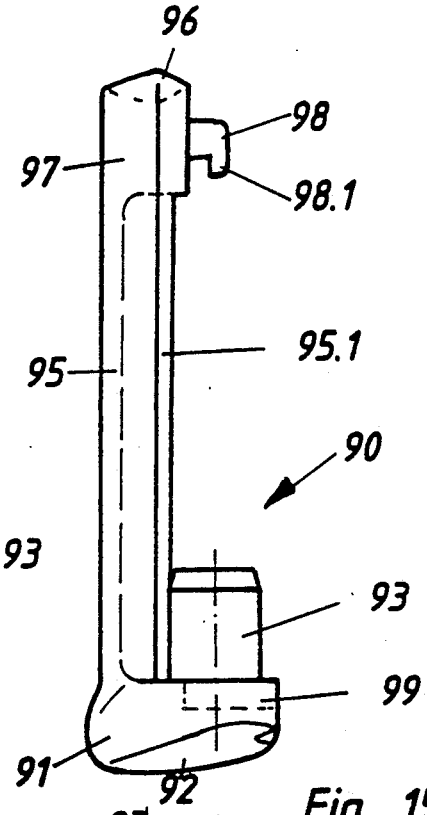
FIG. 15 is a side view of a glider.
Figure 14:
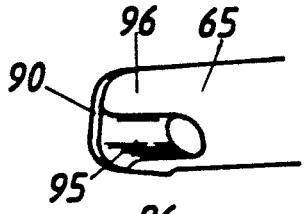
FIG. 14 is a plan view of a chair leg section.
Figure 17:
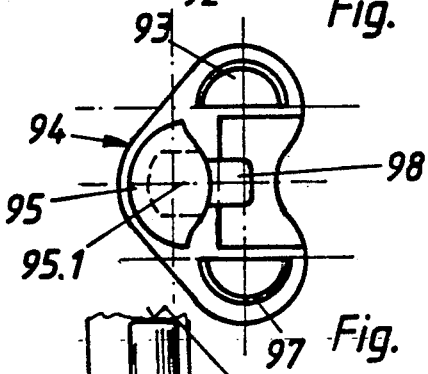
FIG. 17 is a plan view of the glider of FIGS. 15 and 16.

Several suitable profile forms are shown in FIGS. 8 to 11 in which two profiles are shown next to one another as occurs in stacking. The profile of FIG. 8 corresponds to that of the chairs shown in other views while the profiles of FIGS. 9 to 11 represent variations which are not shown in other views but could, however, be used.

The flat tube profile 70.1 shown in FIG. 8 is of dumbbell shape with two thicker bulbous portions 72 which are part-circular or part cylindrical with an extent of about $\frac{3}{4}$ of a circle. These are connected by a central recessed portion 73 which forms about a quarter or a third of a circle. The outer radius of the thicker portions 72 corresponds approximately to the inner radius of the recess portion 73 so that the thicker portion 72 of a superposed leg fits into the recess portion 73 of a lower leg as illustrated in FIG. 8. Through this interfitting of the legs, there is a considerable saving in stacking height because through the angular position of the legs, a stacking height of a few millimeters can be obtained. Moreover, through the interfitting of the legs, the stacked chairs are fixed with respect to one another so that the need of other fixing means is avoided. Furthermore, while providing high stability, the legs have a very slender and attractive appearance. Moreover, the flat profile provides for convenient connection to the seat 52 of the connecting and supporting- .parts 55. The flat form is convenient for penetration to provide screw or bolt holes. The profile is also favorable for forming the bends 64 and 66 and provide good stability after bending.

The flat tube profile 70.1 is preferably formed of sheet steel having a thickness of 1.5 mm. When the flat tube profile 71 is formed by bending and rolling sheet metal, it is preferable to have a longitudinal seam in one of the recess portions 73, 74. Alternatively, the tubing can be seamless. The spacing of the centers 75 of the circles defining the thicker portions can for example be about 21 mm while the outer radius of the thicker portions can for example be about 21 mm while the outer radius of the thicker portions and the inner radius of the recess portions is about 8 mm. Such a profile can be produced endless whereupon suitable lengths are cut-off, bent and welded to form the leg frames 51.

FIG. 9 shows an interesting variation in which the outer surfaces of the flat tube profile 70.2 are formed by five sides of each of two hexagons 82 adjacent sides of which are joined to form recess portions 83. As seen in FIG. 9, the thicker portions formed by hexagons fit into the recessed portions when the chairs are stacked.

The flat profile 70.3 shown in FIG. 10 is formed in effect of two squares which have rounded corners and are joined corner-to-corner whereby adjacent sides 86.1 and 86.2 of the two squares form a central recess portion 85.

FIG. 11 shows a further profile 70.4 of which the thicker portions 87 are formed in effect of two octagons which are joined by connecting walls 88 to form recess portions 89. As seen in FIG. 11, a thicker portion of one leg fits into a recess portion of another leg when the chairs are stacked. Also here there is good interengagement despite relatively limited spacing. All of the above profiles have in effect the form of a dumb bell comprising two enlarged portions connected by a restricted portion forming recesses on opposite sides. The same tube can be referred to as being of double barreled form when considering not the cross sectional profile but the tube pieces. Other similar profile forms are possible. It is essential that thicker outer portions and recessed inner portions fit into one another and form a stable profile which is at least to a large extent closed and is preferably tubular although it can be partially or wholly solid.

The lower end of each leg 65 of the leg frame 51 of dumb bell shape profile 70 is closed by a glider 90 in order to assure that the legs do not damage any floor surface on which the chairs are placed. Such gliders are produced in usual manner of plastic by injection molding and provided with insertable plugs for the tube ends. In the present case, a special form is selected which serves several purposes and which fits the stackable flat tube profile 70.

Figure 13:
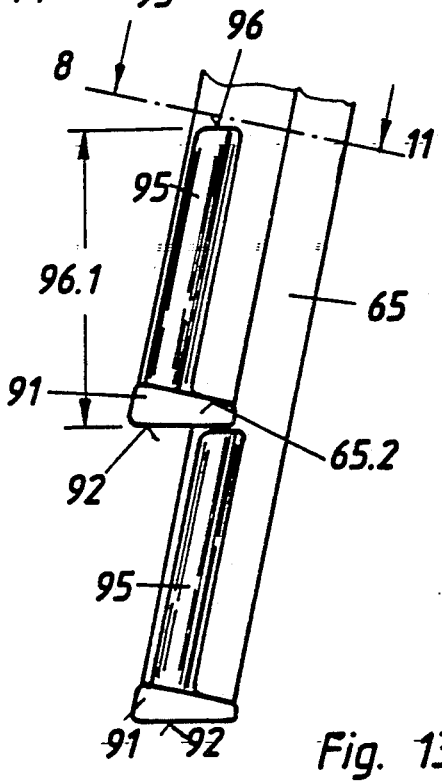
FIG. 13 is a partial side view of the lower portions of the of two stacked chairs.
Figure 12:
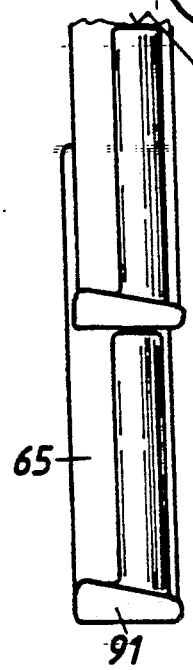
FIG. 12 is a partial front view showing the lower portions of legs stacked chairs.
Figure 21:
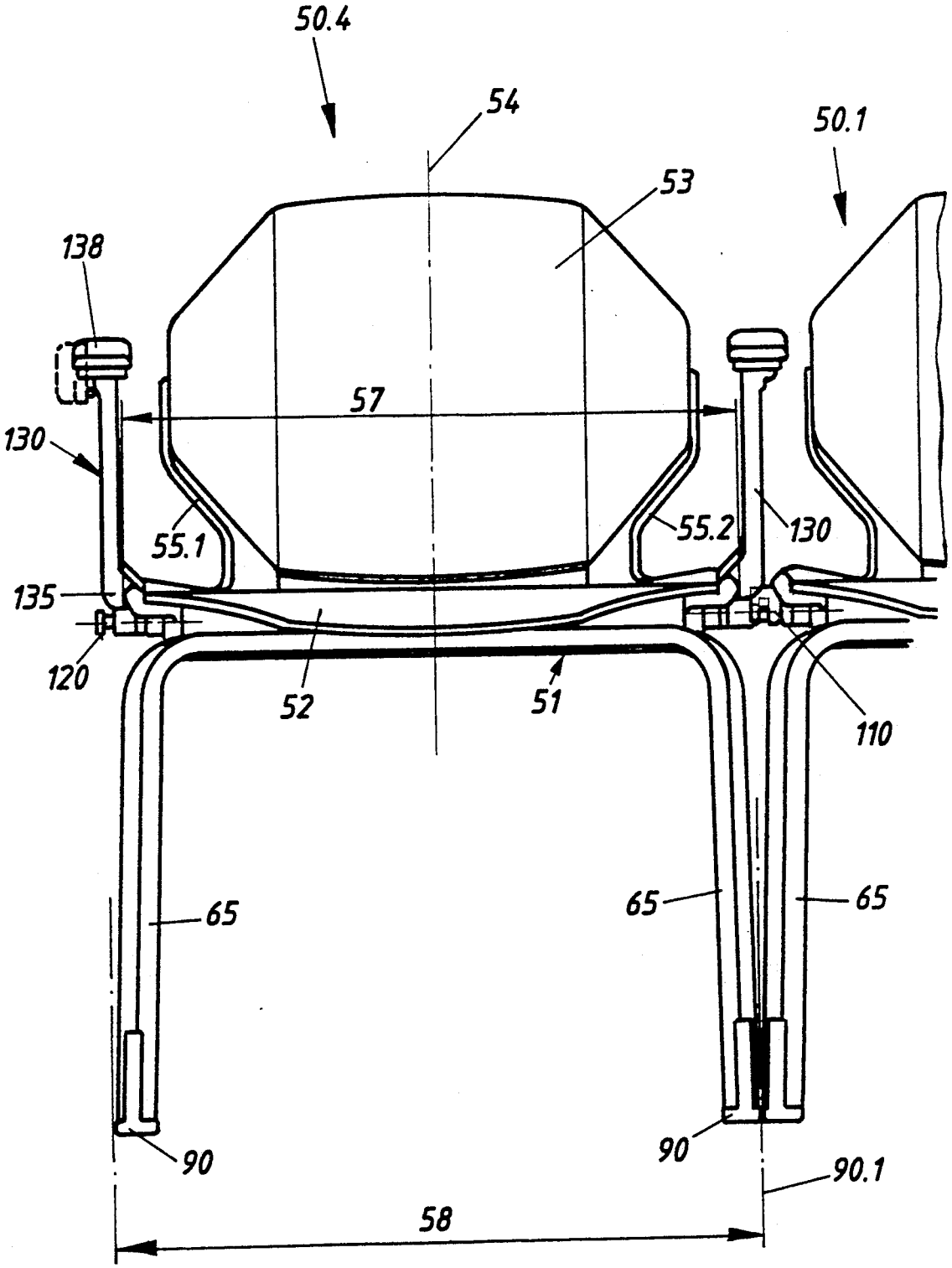
FIG. 21 is a front view of two chairs next to one another and provided with arm rests and linking means for connecting the chairs in a row, the right hand chair being only partially shown.

As illustrated by way of example in FIGS. 12 to 17, the glider 90 has a connecting and supporting plate 91 of which the floor-engaging and supporting surface 92 is inclined with respect to the tube end 65.2 which is normal to the tube axis 65.1 by an angle of about 7° to 12° as illustrated in the drawing. Spaced semi-cylindrical plugs 93 fit into the thicker portions 72 of the leg. On the outer side under the recess portion 73 of the tube profile 70 the base plate 91 is widened in a somewhat triangular shape 94 and carriers a stack supporting lug 95 which fits the profile of the dumb bell form flat tube 70 and is provided with an inner recess 95.1. At its upper end, there is a stacking supporting surface 96 which is inclined at the same angle as the bottom surface 92 so that when the chairs are stacked, the feet are well supported as illustrated in FIGS. 12 and 13. The spacing 96.1 of the floor engaging surface 92 from the stacking supporting 96 is for example about 90 mm which corresponds to the small stacking height of the chairs. The stacking supporting lug is in a region of the tube in which it does not disturb either the appearance or utility of the leg. However, it lies with sufficient wall thickness in the support region of the foot. As it is relatively long, it could tilt relatively to the short plugs 93 if not made of sufficiently stable material. Therefore, its head 97 is formed with a securing hook 98 having a nose 98.1. At a corresponding position in the tube profile, there is provided a hole of corresponding size in which the hook 98 with its nose 98.1 can engage. Thus the inserted glider 90 is not only held against being drawn out but against sideways tilting of the stacking support lug 95.

In its lower region, the glider 90 has a recess 99 in which a double bent clip 100 can be inserted as illustrated in FIGS. 18 and 19 and can be secured to the floor by means of a screw 102 which extends through a hole 101 in the clip 100 and is screwed into an expansion plug 103 in the floor. By reason of the relatively wide and sufficiently thick form of the foot of the glider 90, there is enough space to insert the clip 100 and secure it against being drawn-out sideways.

The chairs described above can, if desired, be supplied with arm rests and/or linking elements for connecting the chairs in a row.

FIGS. 21 and 29 to 35 illustrated how chairs 50 can be connected with one another in a row through linking elements 110. The linking elements 110 are in some respects similar to elements of prior art but have a special shape as clearly shown in FIGS. 30 and 31. It has a body portion 111 with an installation face 112 which fits the outer profile of the seat or of the connecting and supporting part 55. In the middle, it has a screw hole 113 through which a screw 114 extends and is screwed fast on the connecting and supporting part 55.

Figure 32:
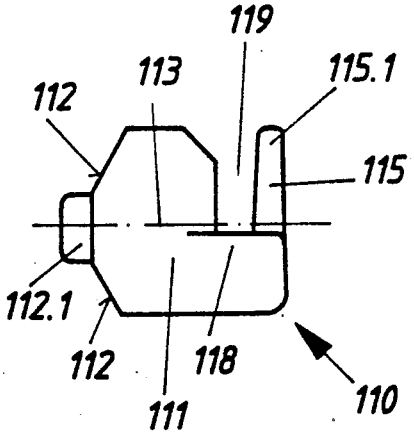
FIG. 32 is a side view of the linking element shown in FIG. 30.
Figure 34:
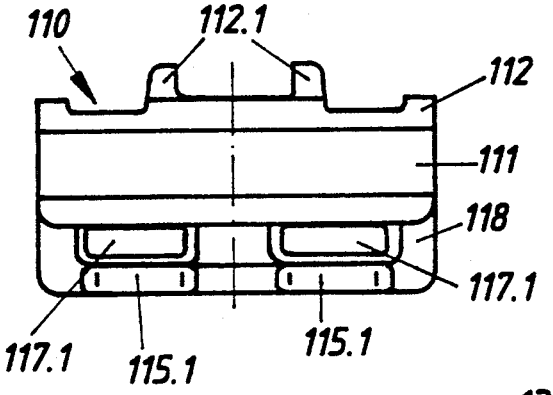
FIG. 34 is a plan view of the linking element according to FIGS. 32 and 33.

The connecting and supporting part 55 has in its edge region, a fastening profile with a support part 55.8 which is roof-shaped in cross section with an inclined outer face 55.82 joining a downwardly and inwardly inclined fixing face 55.83 which ends in a vertical shank 55.9 in which there is provided a bore 108 to receive the screw 114 with a profiled recess for a nut 109. This inclined arrangement of the face 55.83 and the vertical shank 55.9 follow the outer contour of the body portion 111 of the row linking element 110. As seen in FIGS. 32 and 35, the installation face 112 of the linking element 110 is symmetrical with respect to the screw bore 113, being formed on both sides with an angle corresponding to the fixing face 55.83 so that the linking element 110 can be turned so as to be mounted on one side of the chair with the points of the flat lugs 115 pointing upwardly and on the other side of the chair with the points of the flat lugs pointing downwardly. The bore 108 for the screw 114 is in a somewhat prismatic thickened portion 55.91 of the vertical shank 55.9 while otherwise the shank portion has a lesser wall thickness. This thickened portion 55.91 serves as a boss and has a width of about 16 mm. Correspondingly spaced lugs 112.1 formed on the linking element 110 lie next to the thickened portion 55.91 of the vertical shank 55.9 to assist in mounting the linking element and preventing it from turning.

On the linking element, there are formed two flat lugs 115 spaced from the body portion 111 of the linking element by a space 119 to form a U-shaped profile. Between the two flat lugs there is a V-shaped cut-out 116 with a rounded bottom 116.1. The lugs 115 are connected with the body portion 111 by a bottom wall 117 and small cross walls 118 so that there is provided good stability for the lugs 115 with relatively small wall thickness. In the bottom wall 117 there are arranged two openings 117.1 dimensioned to receive the tips 115.1 of the lugs 115 when two chairs are linked together with the lugs of one linking element pointing upwardly and the other downwardly.

So far the linking elements are the same in principal but differ in construction from known linking elements. However, in accordance with the invention, it is possible to mount an arm rest 130 on the chair without lots of spacing and to provide a further simple linking element. This is clearly seen from FIGS. 31 and 35. In the construction shown a longer screw 114.1 extends through the central bore 131.1 of the supporting shank 131 of the arm rest 130 and through a flanged element 120 in which the head of the screw engages. The flanged element 120 has a collar 120.1 which is spaced from the outer face 132.1 of the arm support by a neck portion 120.2 or a spacing tube so that as shown in the drawings the neck portion 120.2 is received in the rounded V-shaped cut-out 116 of a linking element of an adjacent chair while the collar 120 is received in the slot 119 between the body portion 111 and the flat lugs 115 as clearly shown in FIG. 35. The engagement of the linking element 110 with the flanged element 120 can be from above or below depending on which way the linking element is mounted. As chairs are usually provided with arms on both sides and alternate in a row with chairs without arm rests, the chairs with arm rests can be provided with flanged elements 120 on both sides and can on account of the symmetrical and reversible mounting of the linking elements 110 be easily joined with chairs without arm rests. Thus there is only required a longer screw and a simple flanged part for chairs with arm rests. Moreover, the arm rest 130 is provided with a depression 132 of sufficient size so that the flanged element can engage with the lugs of a linking element of an adjacent chair although it does not project beyond the outer edges 133 of the arm rest 130.

Figure 22:
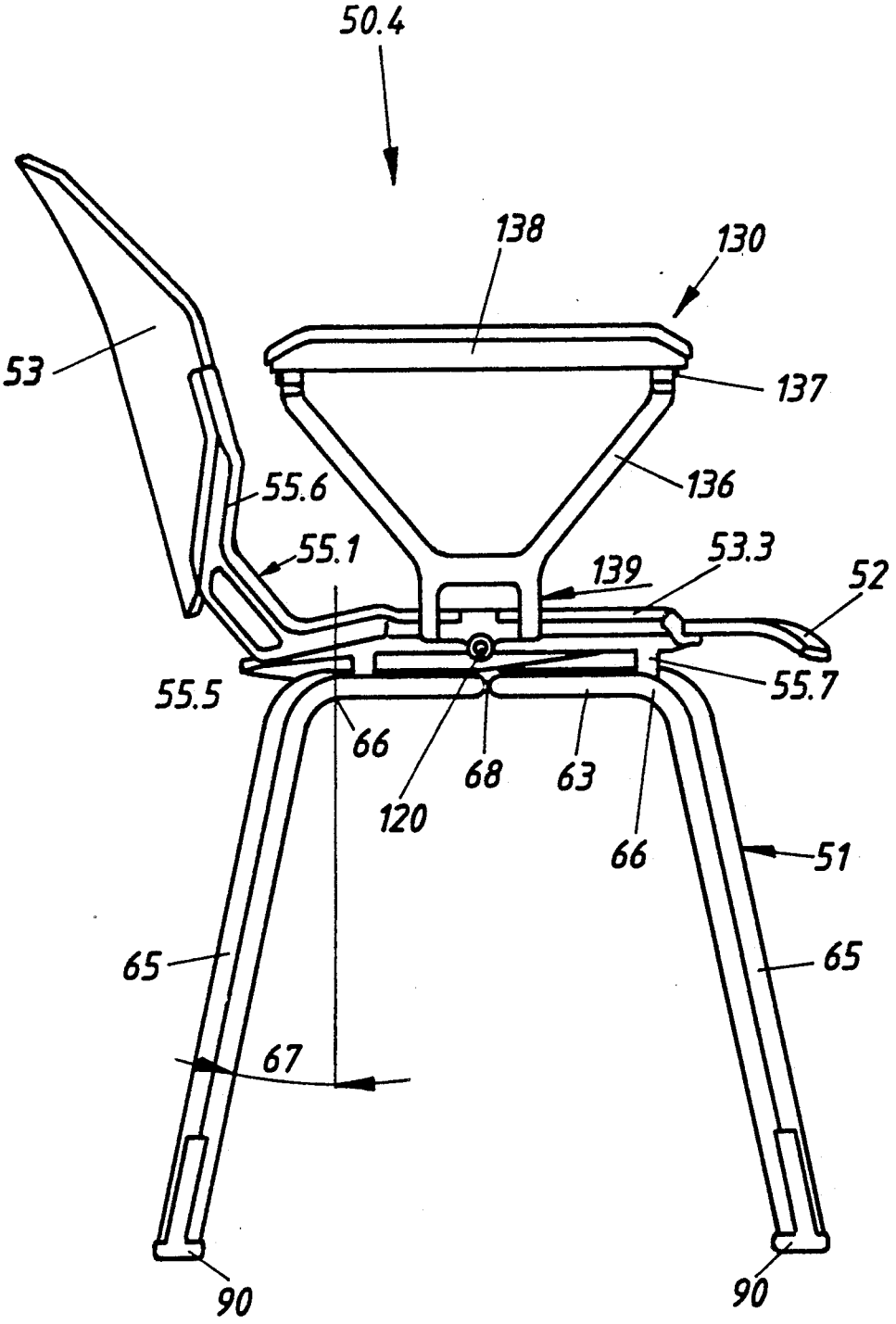
FIG. 22 is a side view of a chair having an arm as shown in FIG. 21.
Figure 23:
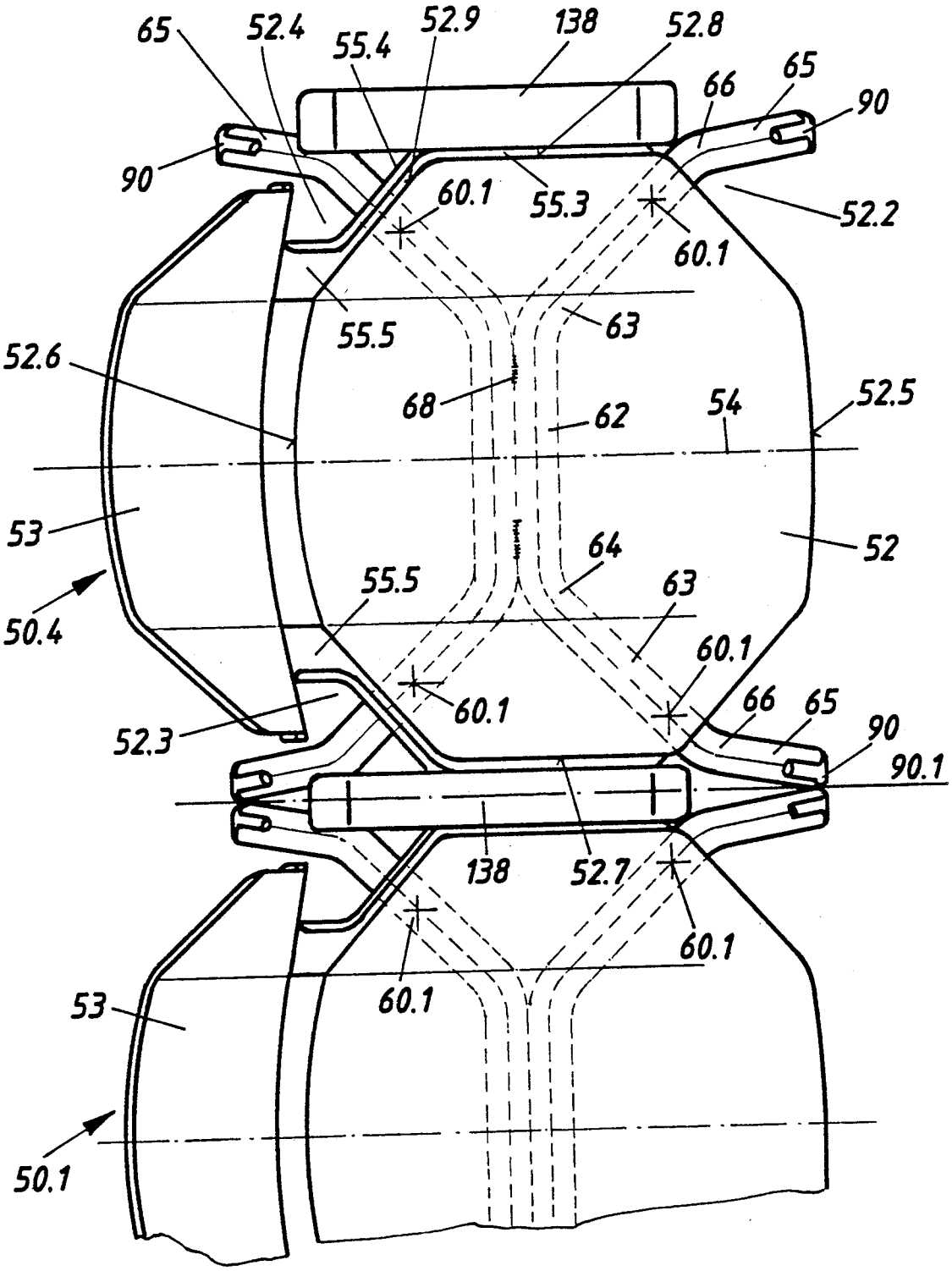
FIG. 23 is a plan view corresponding to FIG. 3 of two adjacent chairs but with arm rests and without breaking away the seat surface.
Figure 24:
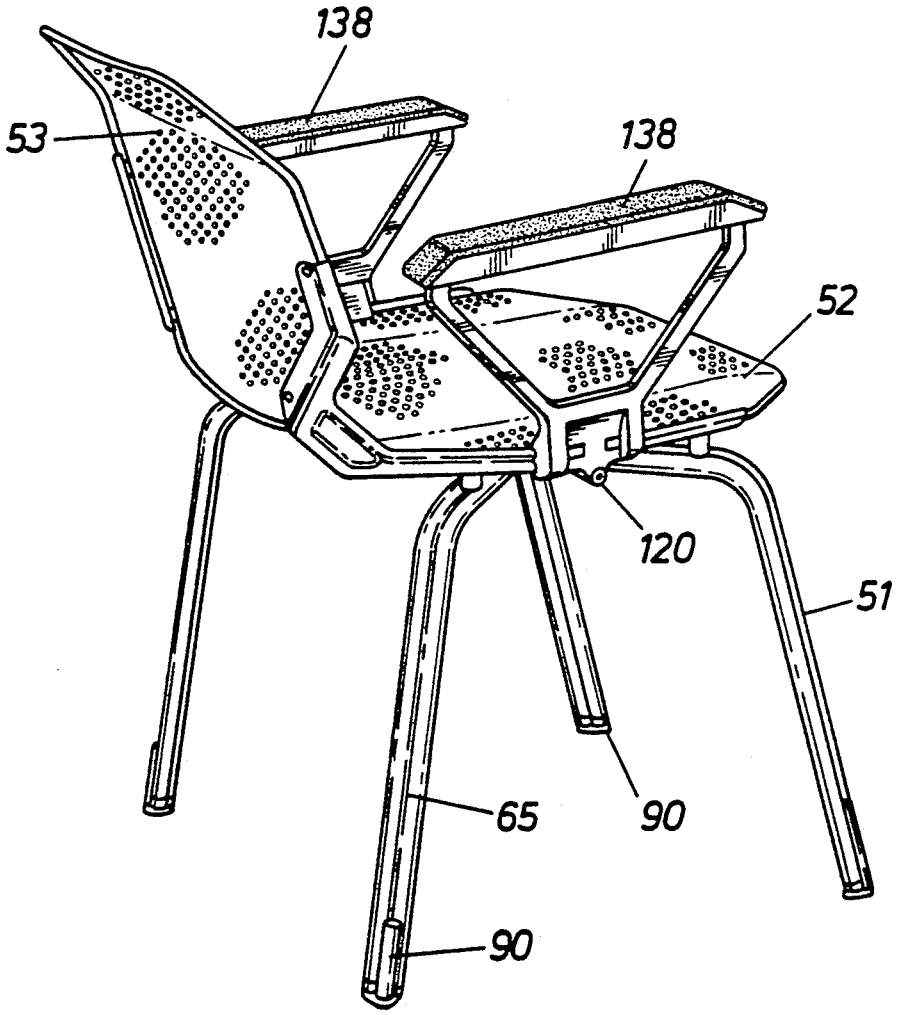
FIG. 24 is a rear side perspective view of a chair provided with arm rests.
Figure 25:
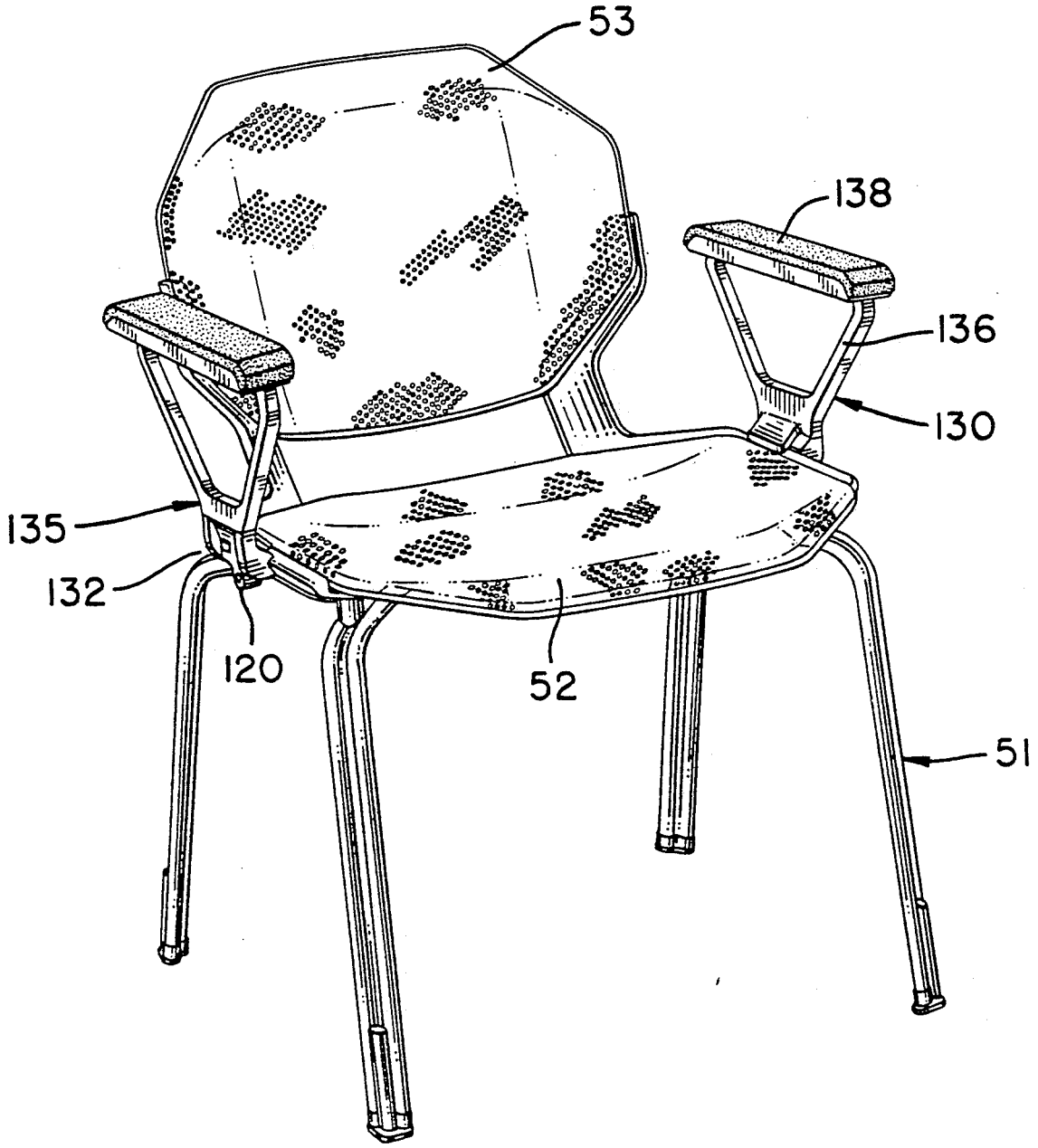
FIG. 25 is a front side perspective view of the chair shown in FIG. 24.

Moreover, the arm rest is mounted on the chair in the following manner. The arm rest 130 can be mounted on the chair 50 described above either when the chair is produced or at any time later. The arm rest 130 has a mounting part 135 of which the shank 131 and depression 132 have already been mentioned. Two support members 136 extend up in a somewhat V arrangement from the mounting part 135 and support a swingable arm rest 38 by means of bearing 137. The swinging is necessary for stacking and to make possible the arrangement of the arm rest centered over the outer edge 90.1 of the seat as will be further described below. As seen in Fig. 22, the mounting part 135 has a certain width 139 of at least 90 mm so that a secured and wobble free mounting can be achieved with a single screw 114.1. As seen in FIG. 35, the mounting part 135 has an overlapping profile 141 which conforms to the roof-shaped profile of the supporting part 55.8 and two spaced from one another, overgripping nose portions 142 or a longer overgripping profile. The outer roof surface 55.82 lies at an angle of less than 90° to the inner roof surface 55.81 and merges into a fixing surface 55.83 which is inclined at an angle of about 15° to the inner roof surface 55.81 so that there is formed a wedge on which the overlapping profile 141 seats and can be drawn down by the screw 114.1 which extend through the shank portion 131 to provide a firm and lasting mounting. The connecting and supporting part 55 has on its inner face a seat supporting groove 125 on which the seat rests and is secured by suitable screws or the like. Through the roof form profile with a rounded edge, the profile form of the seat boundary has a pleasing appearance also for normal use without an arm rest because it forms a stable edge protection. Because of the special form of the entire chair, the seat can be made quite wide relative to the leg frame. The profile is at the same time pleasing in appearance and, when produced as aluminum die casting or by other suitable process, permits the mounting of an arm rest and also provisions for linking mounted with a single screw.

Figure 27:
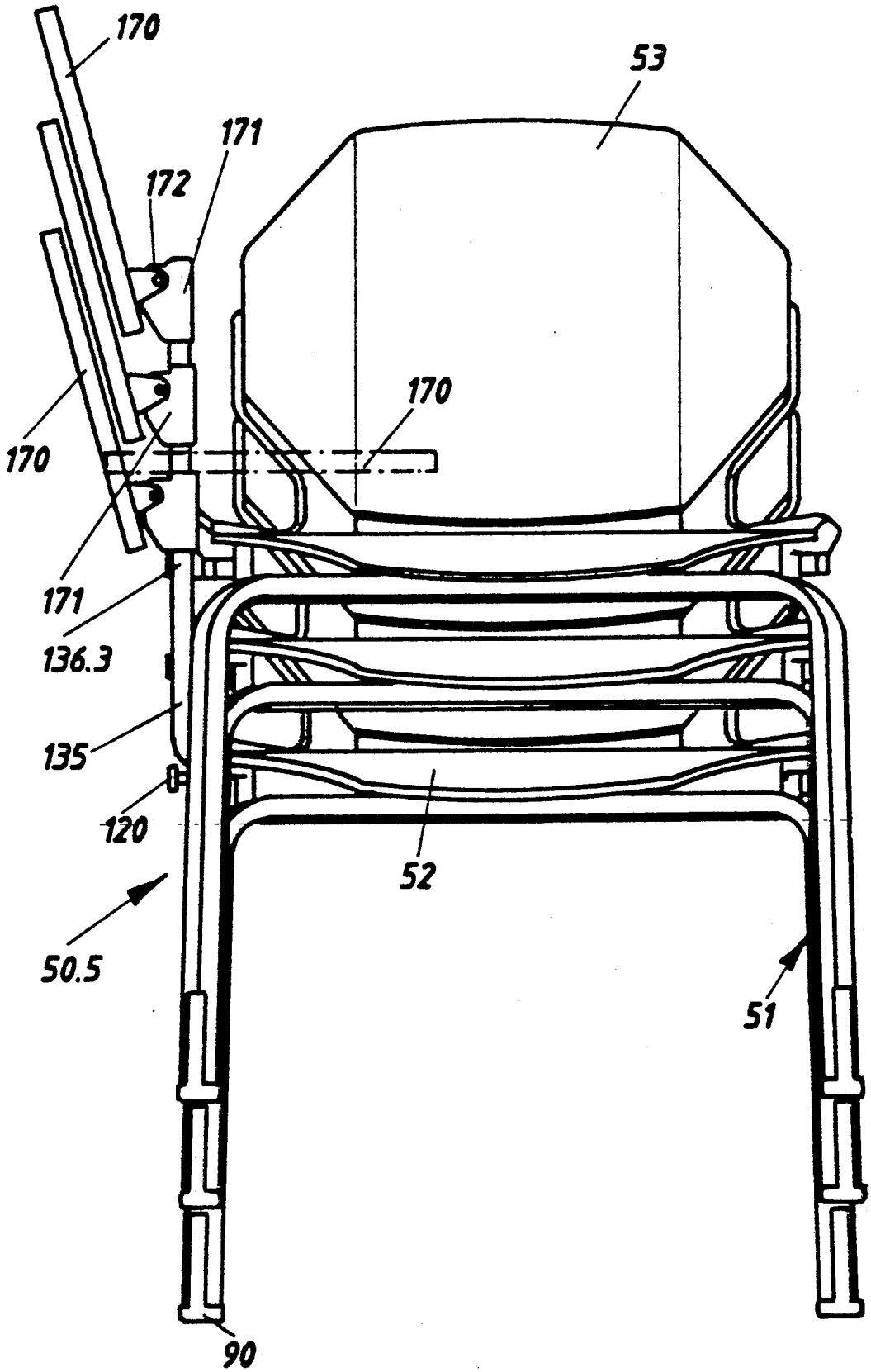
FIG. 27 is a front view of three stacked chairs provided with arm ho and swingable writing tables.
Figure 28:
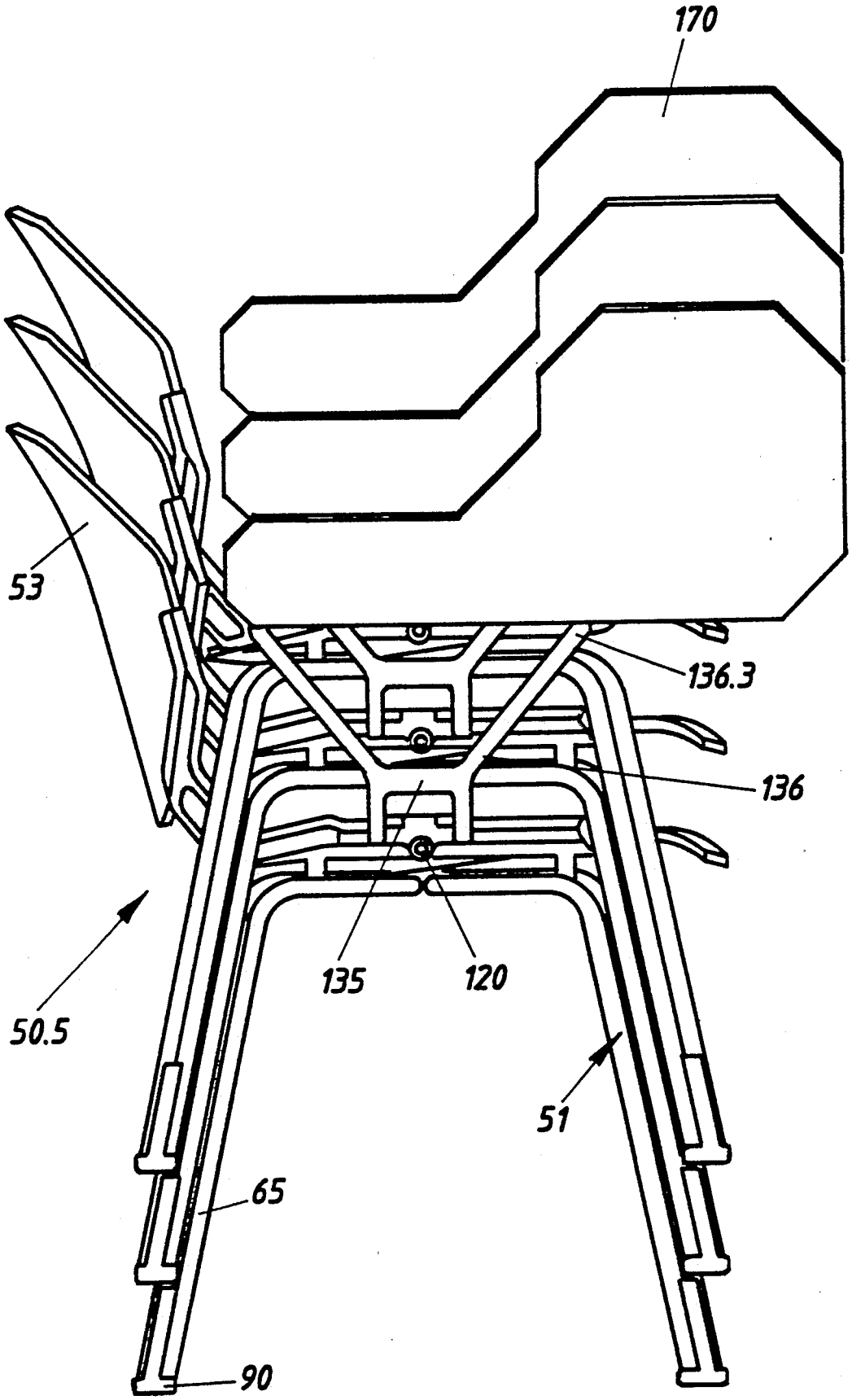
FIG. 28 is a side view of three stacked chairs with swingable writing tables as in FIG. 27.
Figure 29:
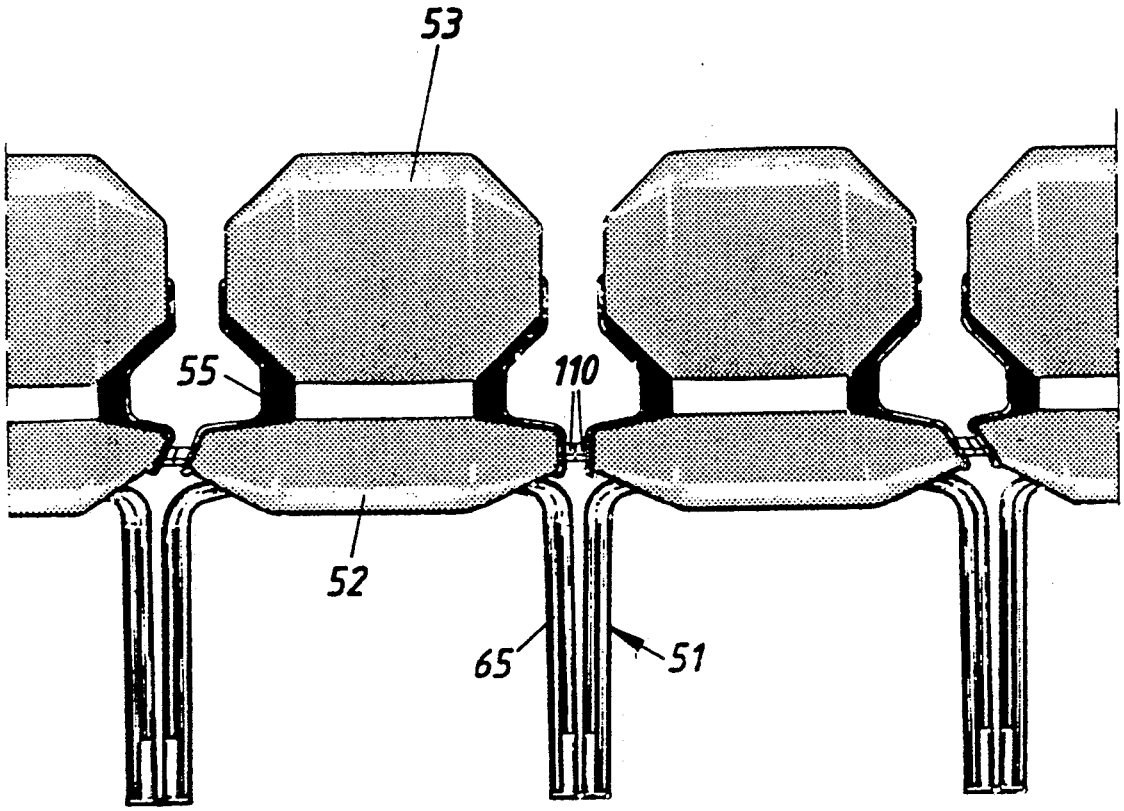
FIG. 29 is a front perspective view of four chairs linked in a row, the outer chairs being only partially shown.
Figure 30:
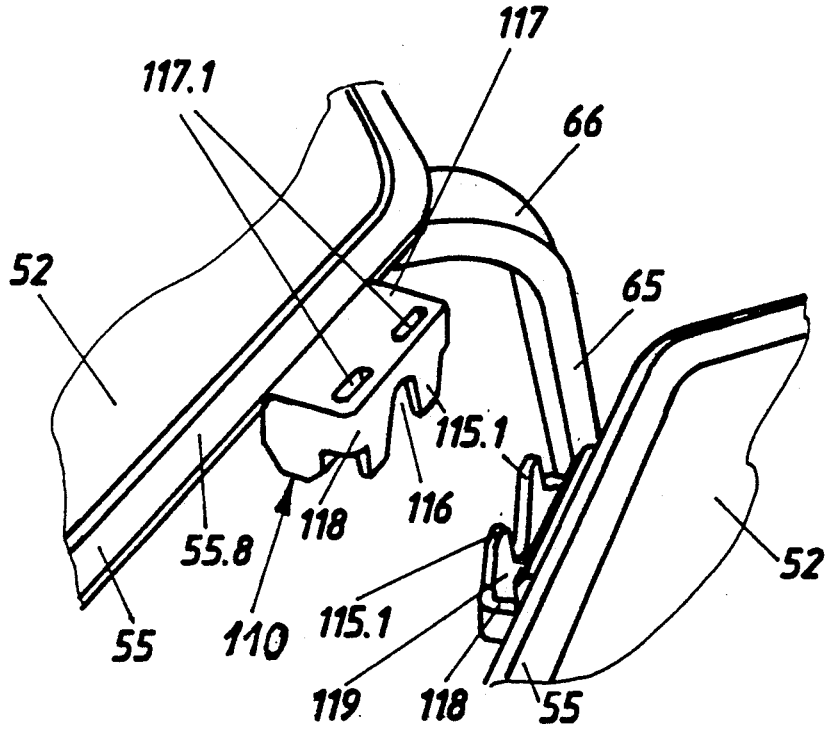
FIG. 30 is a schematic exploded partial view of two chairs with linking elements in position shortly before engagement.
Figure 31:
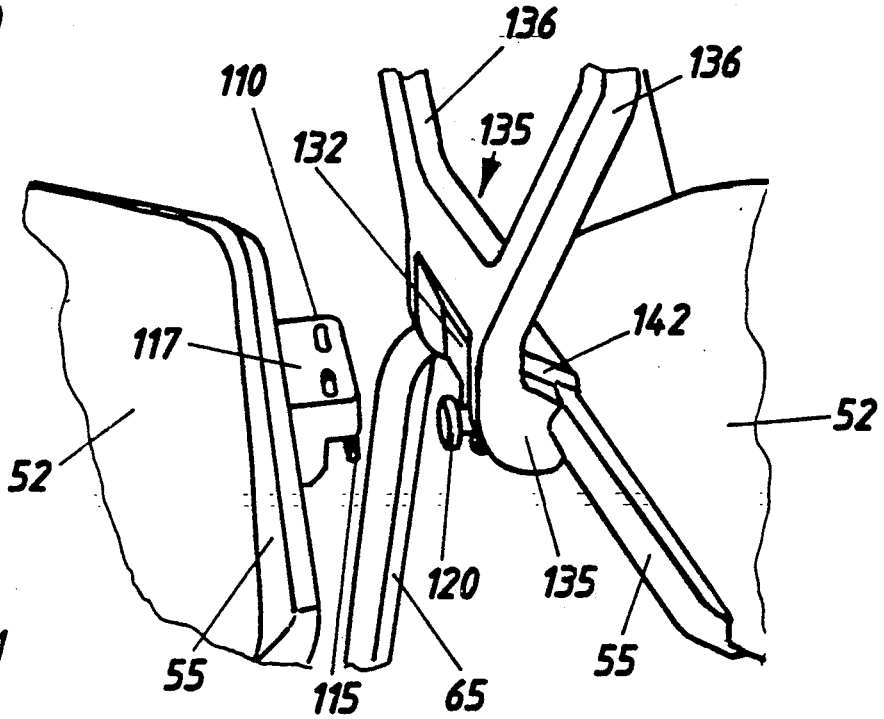
FIG. 31 is a similar view at a somewhat different angle and showing the right hand chair provided with an arm rest.
Figure 33:
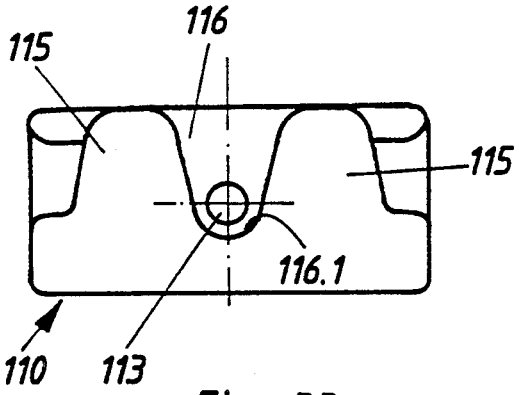
FIG. 33 is a front view of the linking element according to FIG. 32.

FIGS. 27 and 28 show linkable and stackable chairs, provided with a swingable writing table 170 instead of an arm rest. With this chair 50.5 a mounting part 135 with V-form upwardly extending arm supporting members 136 are provided only on the right side of the chair. On the upper ends members 136, there are provided link elements 171 with a pivot axis 172 and bearing surfaces for the writing table 170. The writing table and its pivotal mounting are formed in usual manner but in accordance with the invention the form of the mounting is as described above for the arm rest. As shown in FIG. 27 the writing tables 170 are pivotally mounted so that the chairs can be stacked. Accordingly, the bearing surfaces for the writing table, the mounting elements 35 and the arm support members 136 are so formed as to fit one within another. When such chairs are to be connected in rows, they can be linked with like chairs having writing tables or also with chairs having arm rests or chairs without arm rests. For this purpose, they are provided on the side not having an arm rest, i.e. the left side of the chair with a linking element 100 with flat lugs 115 when this is desired. Stackable chairs provided with arm rests like chairs 50 described above advantageously have an arm rest exactly over the outer edge 90.1 of the feet so that the arm rest 138 lies exactly between two linked chairs and can be used by a person sitting in either. The arm rest must have a certain width so that it will comfortably support an arm. However, it is then in the way for stacking. In order for the chairs to be stackable the arm rest 138 is swingable and the arm support members 136 are arranged in a V-form so that the mounting part 135 is received between the arm support members 136 of a lower chair.

The supporting arms 136.1 and 136.2 have at their upper ends parallel bearings 150.1 and 150.2 for swingably supporting the arm rest 138. These are provided with outwardly projecting bearing lugs 151.1 and 151.2 and moroever, as shown in the drawings have abutment faces 152.1 and 152.2 for positioning the rest in horizontal and vertical positions and with a rounded corner 153. Moreover, the bearing lugs are so formed as to engage in opposite ends of an arm rest 138 of U-shape cross section with one open side.

Figure 26:
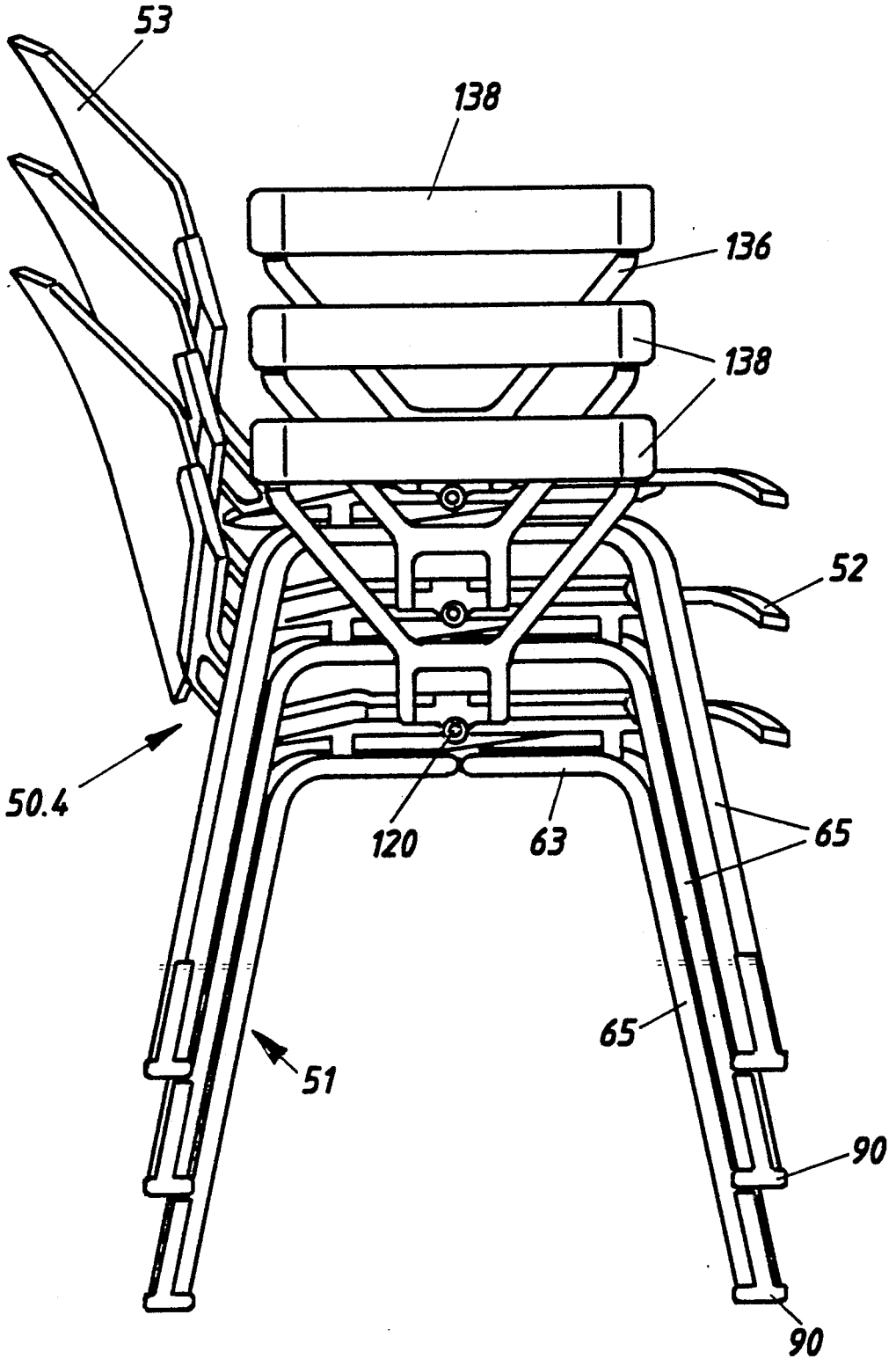
FIG. 26 is a side view of three stacked chairs provided with arm rests.
Figure 36:
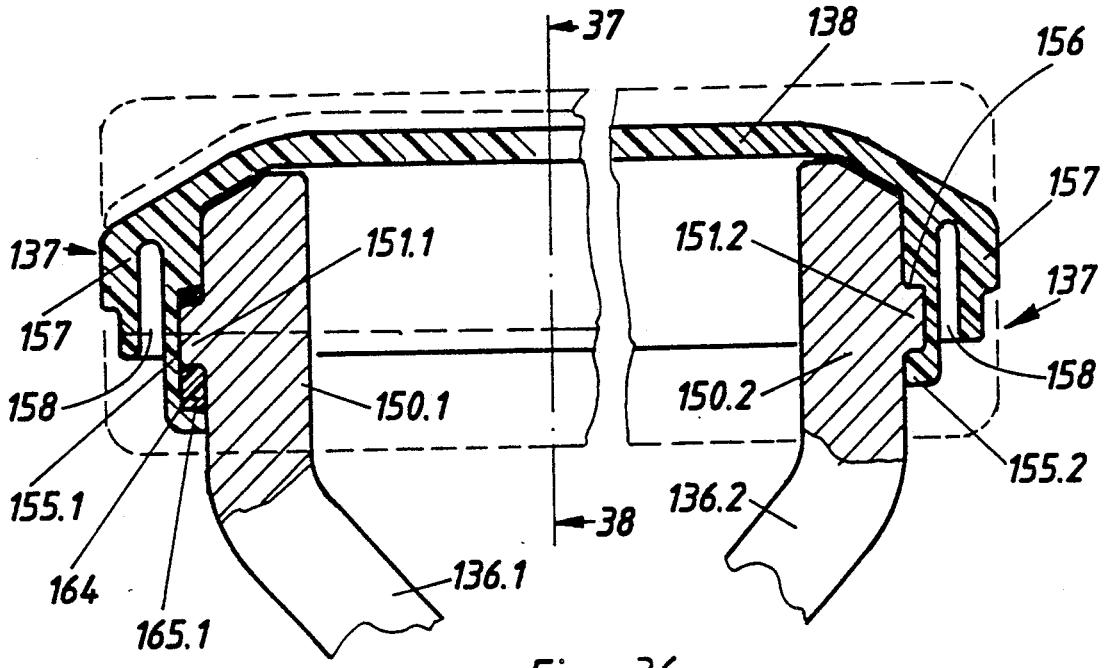
FIG. 36 is a vertical section through the upper portion of an arm rest in the plane of the pivot axis a central portion being broken away.
Figure 37:
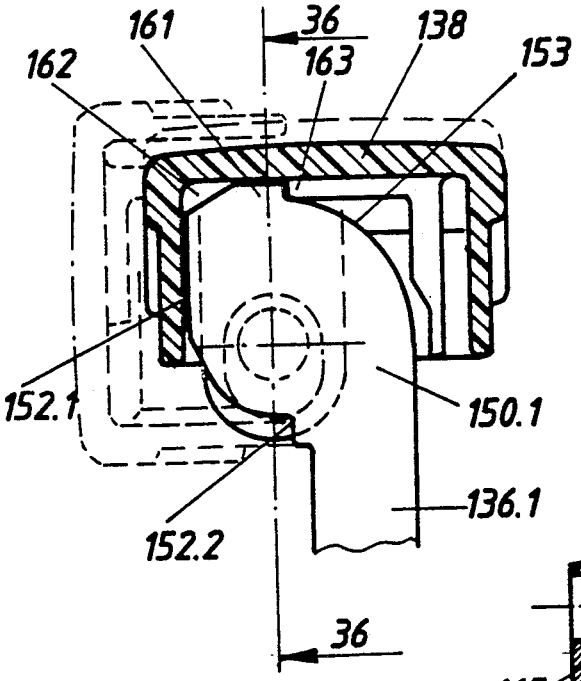
FIG. 37 is a partial cross sectional view along the line 37–38 in FIG. 36 through a pivoted arm rest as shown in FIG. 36.
Figure 38:
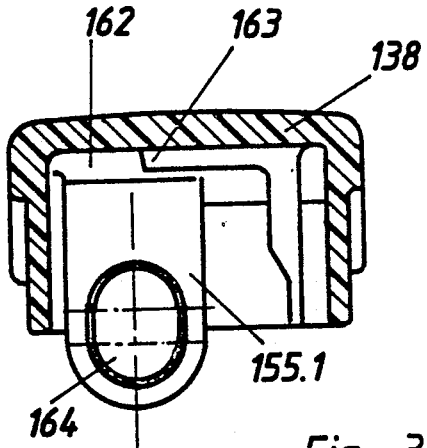
FIG. 38 is a partial vertical section along the line 37–38 in FIG. 36 corresponding approximately to FIG. 37 but without the arm rest bearing part.
Figure 40:
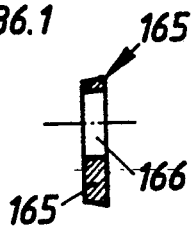
FIG. 40 is a vertical section along the line 40—40 in FIG. 39.
Figure 39:
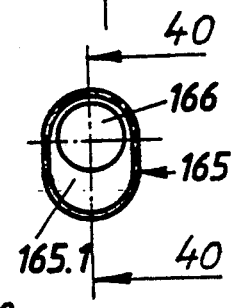
FIG. 39 is a front view of a bearing element for the swingable arm rest of FIG. 38.
Figure 41:
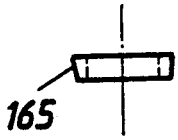
FIG. 41 is a plan view of the bearing element according to FIG. 39 and 40.

The swingable arm rest 138 is inwardly ribbed and box form with easily flexible bearing portions 155.1 at opposite ends. The bearing portions 155.1 have recesses 155.2 to receive the bearing lugs 155.1, 155.2 such recesses having a depth 156 which corresponds to the size of the bearing lugs. The bearing portion 155.1 is separated from the end wall 157 to provide for easy elastic deformation of the bearing portions in order to engage them with the bearing lugs 151, 152. The ribbing wall thickness and other construction of the pivoted arm rests which are made of suitable plastic material are so selected that the bearing portions 155.1 can be readily engaged with the bearing lugs 151.1, 151.2. On the top of one bearing end 150.1 there is a detent nose 161 which is arranged to engage in a detent recess in the swingable arm rest 138 formed by ribbing 163. As is seen from FIGS. 36 to 38 the bearing portion 155.1 is provided with an elongate recess 164 in which lies a highly elastic plastic part which is formed as a support and bearing element 165 made for example of silicon rubber having a hardness of about 50° Shore. The support and bearing element 165 has a bearing recess 166 in which the bearing lug 151.1 rotatable engages and which is offset with respect to the middle of the element so as to provide a lower compressible part 165.1. Through the combined elasticity of the bearing portion 155.1 and the highly elastic support and bearing element 165 which fits in the elongate recess 164 the arm rest can be easily mounted and on the otherhand is retained in position with the help of the detent nose 161 and detent recess 162 in such manner that the swingable arm rest 138 is retained in its end positions. Through compression of the under part 165.1 of the bearing element 165 the end portion of the arm rest can be moved upwardly so that the detent recess 162 clears the detent nose 161 to permit the arm rest to swing from the horizontal position shown in solid lines in FIG. 37 to the vertical position shown in dot dash lines whereby it is outside the arm support members 136 since the axis of rotation as shown in the drawings is likewise outside the support arms. The chairs can then be stacked as illustrated in FIG. 26 since the arm rest 138 are outside the region of the arm rest supports which can interfit with one another by reason of the V-shaped configuration.

We claim:

1. A stackable chair comprising a leg frame having front and rear legs and an integral seat supporting portion, and a seat and back mounted on said leg frame, said seat having a width approximately equal to that of the leg frame and having corner portions cut out to receive the legs of a superposed stacked chair, the rear legs being inclined downwardly toward the rear and the front legs being inclined downwardly toward the front, each of said legs having an elongate, dumb-bell shaped cross section with two like thicker bulbous end portions joined by a thinner recessed central portion and with a major axis disposed at an angle to a plane defined by the front leg and back leg at the same side of the chair, whereby upon stacking of the chairs, thicker portions of the legs of one chair are received in recessed portions of legs of another chair.

2. A chair according to claim 1, in which said leg frame comprises two flat tube parts of dumb-bell shape cross section each bent to provide two downwardly extending legs and an integral connecting portion, means joining said connecting portions under the seat and means for mounting said seat on said leg frame.

3. A chair according to claim 2, in which said connecting portions of said tube parts comprise contiguous parallel portions which are welded together, said tube parts further comprising portions extending from the ends of said parallel portions towards the corner regions of said chair seat and downwardly bent portions forming said legs.

4. A chair according to claim 1, in which said dumb-bell shaped cross section of said legs is of the general shape of two squares joined corner-to-corner.

5. A chair according to claim 1, in which said dumb-bell shaped cross section of said legs is of the general shape of two six-corner polygons having a common side.

6. A chair according to claim 1, in which at the lower end of each leg there is a glider comprising a supporting plate, two fastening portions extending up from said supporting plate into the leg and a stacking supporting portion extending up from said supporting plate and lying at least partially in said recessed portion of the leg.

7. A chair according to claim 6, in which a hook portion at the top of said stacking supporting portion is received in a cutout in the leg to secure the stacking supporting portion to the leg.

8. A chair according to claim 6, further comprising clip means in said glider for securing the chair to the floor.

9. A chair according to claim 1, in which said seat and back are mounted on said leg frame by two like but opposite supporting and connecting members which extend along side edges of the seat and along edges defining rear corner cut-out portions of the seat, then upwardly to said back and along lower and side edges of the back, fastening means securing said supporting and connecting members to said leg frame and means securing said seat and back to said supporting and connecting members.

10. A chair according to claim 9, in which said supporting and connecting members have downwardly projecting bosses slightly inside the cut-out corner portions of the seat resting on said leg frame, said bosses having bores to receive said fastening means for securing said supporting and connecting members to said leg frame.

11. A stackable chair comprising a leg frame, a seat, a back and means mounting said seat and back on said leg frame, said leg frame having front and rear legs and an integral seat supporting portion, said seat being generally of octagon shape with a first front edge, symmetrically opposite second and third edges diverging rearwardly from opposite ends respectively of said first front edge, symmetrically opposite fourth and fifth, side edges extending rearwardly from said second and third edges respectively, symmetrically opposite sixth and seventh edges converging rearwardly from rear ends of said fourth and fifth, side edges respectively, and an eighth, rear edge joining rear ends of said sixth and seventh edges, said back having a first, lower edge, symmetrically opposite second and third edges diverging upwardly from opposite ends respectively of said lower edge, fourth and fifth, side edges extending upwardly from upper ends of said second and third edges respectively, and an upper edge, said seat and back mounting means comprising two like but opposite supporting and connecting members mounted on said leg frame and having side portions which extend along and receive said fourth and fifth, side edges, respectively of said seat, rearwardly converging portions which extend along and receive said sixth and seventh edges respectively of said seat, upwardly extending portions which extend upwardly from rear ends of said rearwardly converging portions to said lower edge of said back, upwardly diverging portions which extend along and receive said second and third edges respectively of said back, and upwardly extending portions which extend along and receive said fourth and fifth, side edges respectively of said back, fastening means securing said supporting and connecting member to said leg frame, and means securing said seat and back to said supporting and connecting numbers.

12. A chair according to claim 11, in which said supporting and connecting members are light metal die castings.

13. A chair according to claim 11, in which each of said supporting and connecting members has in the region of the middle of the respective side edge of the seat, a profile adjacent the side edge of the seat which in cross section has a roof-shaped profile with an inclined outer face and an inclined inner face at an angle of about 100° to 105° to said outer face, a recess to receive the seat and a downwardly extending vertical shank portion.

14. A chair according to claim 13, further comprising an arm rest having a supporting portion with a recess conforming to said roof-shaped profile of said supporting and connecting member and a flange portion overlying said shank portion, said shank portion and flange portion having aligned bores, and a single screw in said bores to secure said arm rest to said supporting and connecting member.

15. A chair according to claim 14, further comprising a flanged element secured to said chair by said single screw and engageable by a linking element provided on an adjacent chair to link two chairs together.

16. A chair according to claim 13, further comprising linking means for linking chairs together side-by-side in a row, said linking means comprising a linking element having a body portion, two flat lugs spaced from said body portion and connected with said body portion by a bottom wall, said lugs defining between them a V-shaped cut-out with a rounded bottom, said bottom wall having spaced openings to receive tip portions of a like but inverted fastening element on an adjacent chair, and means for securing said body portion of said linking element to said supporting and connecting member of the chair.

17. A chair according to claim 16 in which said body portion of said linking element has a face conforming to the outer face of said supporting and connecting member and is secured to said supporting and connecting member by a single screw in aligned bores in said body portion and said supporting and connecting member.

18. A chair according to claim 7, in which said supporting and connecting member has an outer face with a shallow V-configuration and in which said body portion of said linking element has a face which conforms to the outer face of said supporting and connecting member and is symmetrical with respect to said bore in said body portion, whereby said linking element can selectively be reversibly mounted on said supporting and connecting member so that said flat lugs point up or point down.

19. In combination with a first chair according to claim 16, a second chair of generally like construction having an arm rest and a flanged element secured to said supporting and connecting member at one side of the chair, said flanged element being received in said V-shaped cut-out of said linking element of said first chair to link said chairs together.

20. A chair according to claim 14 in which said legs have feet and lie substantially in a vertical plane, and in which the middle of the arm rest lies over the outer edges of the feet.

21. A chair according to claim 11, in which said supporting and connecting members are recessed to receive edge portions of said seat and back.

22. A chair according to claim 13, further comprising an arm mounted on one of said supporting and connecting members, said arm comprising a base portion having a recess fitting over said roof-shaped profile of said member, two support arms extending up from said base portion and diverging upwardly in a V-configuration and an arm rest extending between and pivotally mounted on upper ends of said support arms for pivotal movement about a horizontal axis between a horizontal portion and a tilted-up position, the pivot axis of said arm rest being off-set laterally outwardly from a central vertical plane of said support arms, so that the arm rest when in tilted-up position is out of line with said support arms to permit stacking of like chairs, and a screw removably securing said base portion on said roof-shaped profile of said member.

23. A chair according to claim 22, further comprising a linking element for linking a pair of like chairs, said linking element being removably secured to said supporting and connecting member by the same screw recurring said base portion of said arm to said member.

24. A stackable chair comprising a leg frame and a seat and back mounted on said leg frame, said leg frame comprising two tubes of uniform cross section having horizontal portions under said seat and end portions bent downwardly to form legs, two legs being formed by each tube, and means joining said horizontal portions with one another, rear legs being inclined downwardly toward the rear and front legs being inclined downwardly toward the front, each of said legs having a non-circular cross sectional shape with a circumference having outwardly convex and outwardly concave portions to provide respectively convex and concave outer surface portions so disposed circumferentially of the legs that when two like chairs are stacked one on another, convex outer surface portions of legs of one chair engage with concave outer surface portions of legs of another like chair.

25. A stackable chair according to claim 24, in which said seat and back are mounted on said leg frame by two like but opposite supporting and connecting members which have horizontal forward portions secured to said leg frame at opposite sides of the chair and underlying the seat and upwardly extending rear portions to which the back is secured.

26. A stackable chair comprising a leg frame and a seat and back mounted on said leg frame, said leg frame comprising two tubes of uniform cross section having horizontal portions under said seat and end portions bent downwardly to form legs, two legs being formed by each tube, and means joining said horizontal portions with one another, rear legs being inclined downwardly toward the rear and front legs being inclined downwardly toward the front, said legs being of a noncircular cross sectional shape with a circumference having outwardly convex and outwardly concave portions to provide respectively convex and concave outer surface portions so disposed circumferentially that when two like chairs are stacked one on another, convex outer surface portions of legs of one chair engage with concave outer surface portions of legs of another like chair, and gliders secured on lower end portions of said legs, said gliders having lower support surfaces for engagement with a floor surface and upper support surfaces for engagement by gliders of an upper chair when like chairs are stacked.

27. A stackable and linkable chair comprising a leg frame, seat and back, said leg frame comprising two tubes bent to form horizontal intermediate portions and downwardly bent end portions forming legs and means interconnecting said horizontal portions, said legs comprising downwardly and forwardly inclined front legs and downwardly and rearwardly inclined rear legs, said tubes being of a non-circular cross sectional shape providing convex outer surface portions and concave outer surface portions adapted to receive said convex outer surface portions of another chair when like chairs are stacked, seat and back supporting members at opposite sides of said chair, said seat and back supporting members having parallel horizontal seat supporting portions receiving opposite sides of said seat, rearwardly converging portions at the rear of said parallel portions and upwardly diverging back supporting portions extending upwardly from said rearwardly converging portions, means mounting said seat and back supporting members on said leg frame, said mounting means comprising spacing members spacing said seat and back supporting members upwardly from said horizontal portions of said tubes and means securing said seat and back supporting members to said leg frame, said seat having a width substantially equal to the width of said leg frame and having cut-out corner portions accommodating legs of an upper chair when two like chairs are stacked, and means on said horizontal portions of said seat and back supporting members for interlinking a plurality of like chairs in a row.

* * * * *